US009163490B1

(12) United States Patent
Hill et al.

(10) Patent No.: US 9,163,490 B1
(45) **Date of Patent: *Oct. 20, 2015**

(54) OIL SHALE PRODUCTION SYSTEM USING A THERMAL-ENERGY-CARRIER FLUID FOR CREATING A POROUS HEATING ELEMENT IN A HIGHLY PERMEABLE ZONE

(76) Inventors: Gilman A. Hill, Englewood, CO (US); Joseph A. Affholter, Coleman, MI (US)

( * ) Notice: Subject to any disclaimer, the term of this patent is extended or adjusted under 35 U.S.C. 154(b) by 489 days.

This patent is subject to a terminal disclaimer.

(21) Appl. No.: 12/383,539

(22) Filed: Mar. 25, 2009

Related U.S. Application Data

(63) Continuation-in-part of application No. 11/455,438, filed on Jun. 19, 2006, now Pat. No. 7,980,312.

(51) Int. Cl.
*E21B 43/24* (2006.01)
*E21B 36/00* (2006.01)

(52) U.S. Cl.
CPC ..... *E21B 43/24* (2013.01); *E21B 36/00* (2013.01)

(58) Field of Classification Search
None
See application file for complete search history.

(56) References Cited

U.S. PATENT DOCUMENTS

| | | | | |
|---|---|---|---|---|
| 2,969,226 | A * | 1/1961 | Huntington | 166/271 |
| 4,026,359 | A * | 5/1977 | Closmann | 166/272.3 |
| 7,980,312 | B1 * | 7/2011 | Hill et al. | 166/303 |
| 8,261,823 | B1 * | 9/2012 | Hill et al. | 166/272.1 |

* cited by examiner

*Primary Examiner* — Angela M DiTrani
(74) *Attorney, Agent, or Firm* — Edwin H. Crabtree; Ramon L. Pizarro

(57) ABSTRACT

An in-situ oil shale production system used for economically mobilizing and extracting hydrocarbons in an underground oil shale deposit. The production system includes a plurality of injection wells, a plurality of production wells and a thermal energy carrier, called herein "TECF". The TECF is injected through the injection wells into a naturally occurring, highly-permeable zone. The highly-permeable zone is used to create a porous heating element. The porous heating element, at high temperatures in the range of 900 to 1300 degrees F., mobilizes and retorts the hydrocarbons in the porous heating elements. The hydrocarbons with the TECF then flow from the porous heating element through the production wells to the ground surface for refining. The surface area of the large porous heating element provides a means for economic, in-situ retorting of hydrocarbons from a carbon-rich, oil shale geologic formation.

22 Claims, 23 Drawing Sheets

OIL SHALE PRODUCTION SYSTEM USING A THERMAL-ENERGY-CARRIER FLUID FOR CREATING A POROUS HEATING ELEMENT IN A HIGHLY PERMEABLE ZONE

This is a Continuation-In-Part patent application of a prior Utility Patent Application, titled "Integrated In-situ Retorting And Refining Of Oil Shale", filed on Jun. 19, 2006, Ser. No. 11/455,438, now U.S. Pat. No. 7,980,312 by Gilman A. Hill and Joseph A. Affholter.

Also, the applicant/inventor claim the benefit of a Provisional Patent Application, titled "Oil-Shale Production System", as filed on Mar. 26, 2008, Ser. No. 61/072,093, by Gilman A. Hill.

BACKGROUND OF THE INVENTION (a) Field of the Invention

This invention relates to the production of hydrocarbons, water and other products from a fixed-bed carbonaceous deposit such as well characterized in oil shale deposits, in coal bed deposits, in tar sand deposits and other geological formations found in the western United States and Canada and more specifically, but not by way of limitation, to an in-situ production system for the extraction of hydrocarbons and other products in an oil shale deposit. The production system uses a plurality of injection wells and production wells with a thermal energy carrier fluid, called herein "TECF". The TECF is used to create a porous heating element in a horizontal or near-horizontal highly-permeable zone for retorting hydrocarbons from the highly-permeable zone and adjacent less-permeable zones.

(b) Discussion of Prior Art

Heretofore, most prior-proposed, in-situ oil shale retorting technologies are dependent on oil shale rock formations for radial transmission of thermal energy Btu's from the wall of a well bore out into the surrounding rock. In this type of radial geometry, heat flow outwardly from a very small porous heating element surface area of a well bore wall (i.e., about 2 to 3 square feet per foot of well bore porous heating element length), the Btu's heat flow rate is very limited. This limited, heat flow rate per well bore thereby requires drilling a large multiplicity of closely spaced well bores to achieve economic production rates. Such a requirement for a multiplicity of closely spaced well bores is environmentally unacceptable and is economically very cost/price limiting.

The subject oil shale production system is based on the injection, from a line of injection wells, of TECF as volatilized hot vapors, into either a horizontal or near-horizontal, natural-occurring, highly-permeable zone or a horizontal or near-horizontal, highly-permeable hydraulic fracture zone to create a desired, very large porous heating element in an underground surface area. The surface area of the large porous heating element provides a means for economic, in-situ retorting hydrocarbon form a carbon-rich, oil shale geologic formation,

SUMMARY OF THE INVENTION

A primary objective of the subject oil shale production system is to use a naturally-occurring, horizontal, highly-permeable zone or a highly-permeable hydraulic fracture zone for circulating TECF there through and creating a porous heating element. The porous heating element used for the economic recovery of hydrocarbons, purified water and other products from fixed-bed carbonaceous deposits, as illustrated herein and using an oil shale formation as an example of the subject production system.

Another key objective of the production system is the use of widely spaced injection and production wells, from ½ to 1 mile apart, thus eliminating closely spaced, well bores that are environmentally unacceptable and uneconomical in the in-situ extraction of hydrocarbons from oil shale.

Still another object and advantage of the invention is the production system creates an underground, porous heating element between a plurality of injection wells and production wells that creates over 4000 times more thermal energy for retorting oil shale when compared to a typical 500 foot long well bore with porous heating element, used in prior oil shale retorting experiments.

The subject oil shale production system uses a plurality of widely spaced apart injections wells and production wells for circulating TECF underground into a horizontal, highly-permeable zone or a highly-permeable hydraulic fracture zone. The TECF is used to create a very large porous heating element for extracting hydrocarbons from the permeable zone and adjacent less-permeable zones.

These and other objects of the present invention will become apparent to those familiar with in-situ retorting and refining of hydrocarbons in underground deposits when reviewing the following detailed description, showing novel construction, combination, and elements as herein described, and more particularly defined by the claims, it being understood that changes in the embodiments to the herein disclosed invention are meant to be included as coming within the scope of the claims, except insofar as they can be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figures 1A, 1B, 1C:
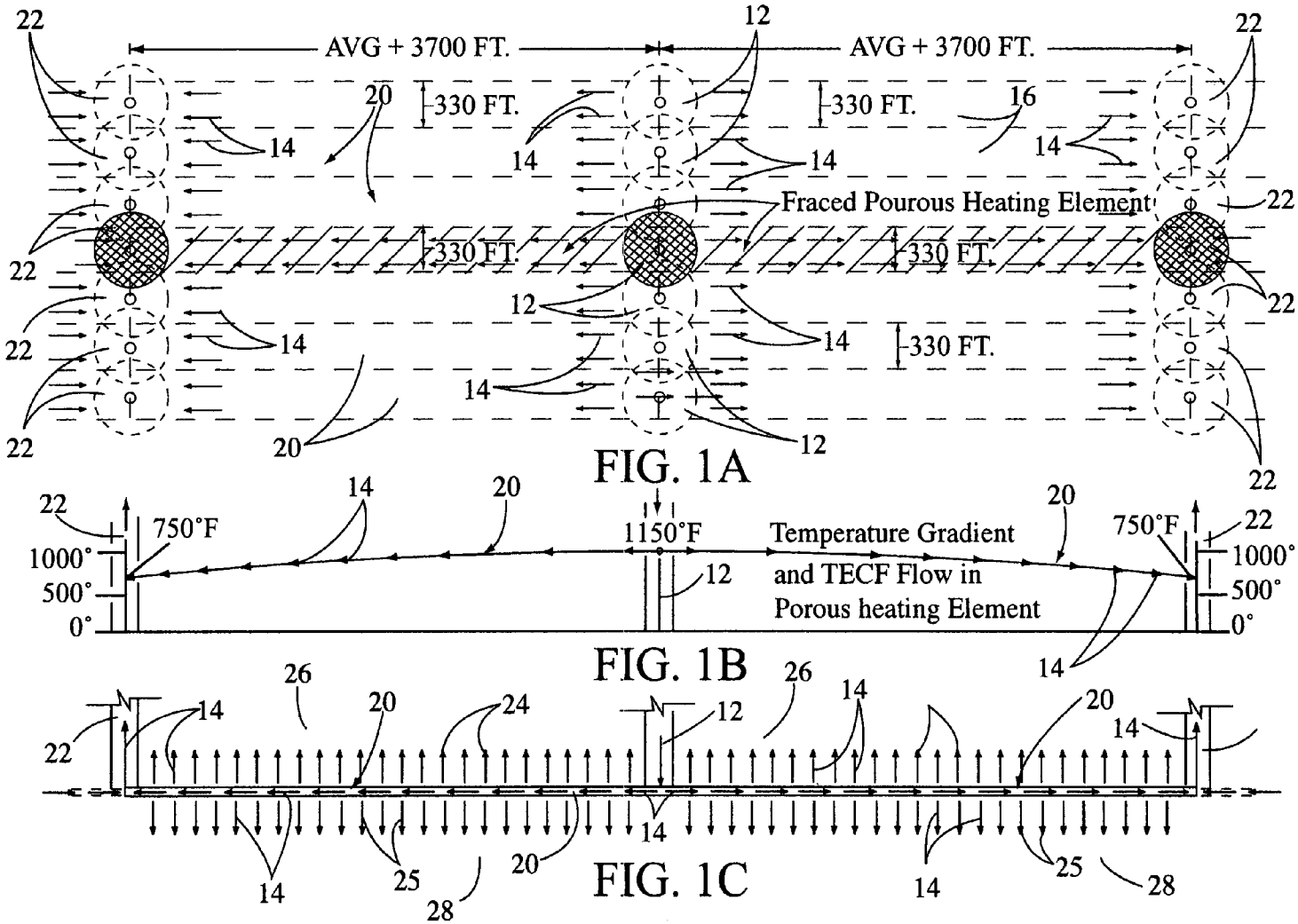
FIG. 1A illustrates a top view of a plurality of injection wells drilled into a ground surface for injecting the TECF there through and widely spaced apart production wells disposed on either side of the injection wells for receiving the TECF and retorted hydrocarbons from a highly-permeable zone.
FIG. 1B illustrates a temperature gradient and TECF flow from one of the injection wells through a porous media to production wells on opposite sides of the injection well.
FIG. 1C illustrates heat flow from a highly-permeable zone to less-permeable zones above and below the highly-permeable zone.

The subject oil shale production system, shown in the drawings having general reference numeral 10, is based on injecting, from a line of injection wells 12, a high temperature thermal energy carrier fluid or TECF, typically in a range of 900 to 1300 degrees F. and more specifically 1,150° F.±10%, as volatilized hot vapors and shown as arrows 14. The TECF is injected through the injection wells 12 into either a natural occurring, porous, highly-permeable zone 16, or a highly-permeable hydraulic fracture zone 18. The hot TECF 14, injected into the highly-permeable zone 16, will create a large, square-footage area of a thermal porous heating element, having general reference numeral 20 and shown in FIG. 1C, extending between widely spaced, parallel lines of the injection wells 12 and production wells 22. The thermal energy or heat from the hot porous heating element 20 in the highly-permeable zone 16 will flow by thermal conductivity along a linear path perpendicular to the horizontal porous heating element's surface. Because of the very large area of the porous heating element 20, a very high volume rate of Btu's per day can be injected through each injection well 12. Likewise, very large volume rates of retorted hydrocarbon products plus partially cooled TECF, can be produced through each production well 22 from the porous heating element 20 in the highly-permeable zone.

In FIGS. 1A, 1B and 1C, a line of injected wells 12 are spaced in a range of 200 to 500 feet and more specifically 330 ft apart and between two adjacent, parallel lines of productions wells 22. The space between the injection wells and production wells can be from ½ to 1 mile apart and averaging about 0.7 mile or 3,700 ft. The square footage of the horizontal or near-horizontal, TECF-injected porous heating element 20 is attached to each injection well 12 and production well 22 and will be about 2,442,000 sq ft (i.e., 2×3,700×330 ft). The porous heating element 20, attached to the bore of each injection well 12, will have an upper surface area of 2,442,000 sq ft from which thermal energy or heat can flow upwardly, as shown by arrows 24, along a linear, heat-flow path, perpendicular to the porous heating element's surface, by thermal conductivity through an upper less-permeable zone 26 (probably from 0.1 to 10 microdarcys matrix permeability), as shown in FIG. 1C. Also, the porous heating element 20 will heat a lower less-permeable zone 28 of the same 2,442,000-sq-ft area from which thermal energy, as shown by arrows 25, can flow downwardly in a similar manner and magnitude to the above-described, upward heat flow to the upper less-permeable zone 26.

It should be noted in FIG. 1A, a plurality of parallel porous heating elements are shown with TECF, as indicated by arrows 14, flowing from the injections wells 12 outwardly toward the productions wells 22 and creating parallel porous heating elements 20 next to each other. One of the porous heating elements, in the center of the drawing, is shown having cross-hatching to indicate that this particular heating element has been frac stimulated for increased TECF flow therethrough.

The total TECF porous heating element's surface area, attached to each injection well 12 from which thermal energy flows linearly upward and downward by thermal conductivity, will be about 4,884,000 sq ft (i.e., 2,442,000-sq-ft, upper-surface area, plus 2,442,000 sq-ft, lower-surface area). In comparison, a 9 inch diameter well bore, containing a 500 foot long, well-bore porous heating element will have a surface area of about 1,180 sq-ft from which thermal energy can flow radially outward by oil-shale-rock thermal conductivity. Therefore, this proposed geometry of a TECF-injected, horizontal, porous heating element 20 in the highly-permeable zone 16 has over 4,000 times more surface area for linear-thermal-conductivity heat flow than a 500-ft-long, well-bore porous heating element has for radial, thermal-conductivity heat flow.

The preferred, Btu's/d, TECF injection rate is 4 billion Btu's/d per injection well 12. When each injection well 12 is drilled, each highly-permeable zone 16 is tested for its fluid-injection capacity. In some zones, where substantial volumes of water soluble nacholite and other salts have been leached out, the natural permeability can be several darcys (possibly 10 to 50 darcys). If higher injection capacity is needed, then that zone can be hydraulically fractured and propped by a 10 to 20-mesh or a 8 to 12-mesh, very high-permeability, frac-proppant sand. Such propped-frac, stimulated, permeable zones in each well can create a capability of injecting enough TECF to provide 4 billion Btu's/d/well of thermal energy injection. If this volume rate of TECF injectivity in each well cannot be achieved, then additional wells can be drilled and completed either in different zones at the same drill site or in the same zone at a different drill site (possibly at an intermediate drill-site location) until sufficient wells, with adequate injection capacity, are available to inject the 4 billion Btu's/d of TECF at a drill site, or possibly at 2 or more integrated drill sites. This 4 billion Btu's/d of injected TECF will create about 2,700 boe/d gross production, resulting in about 2,000 boe/d net marketable production.

Figure 2A:
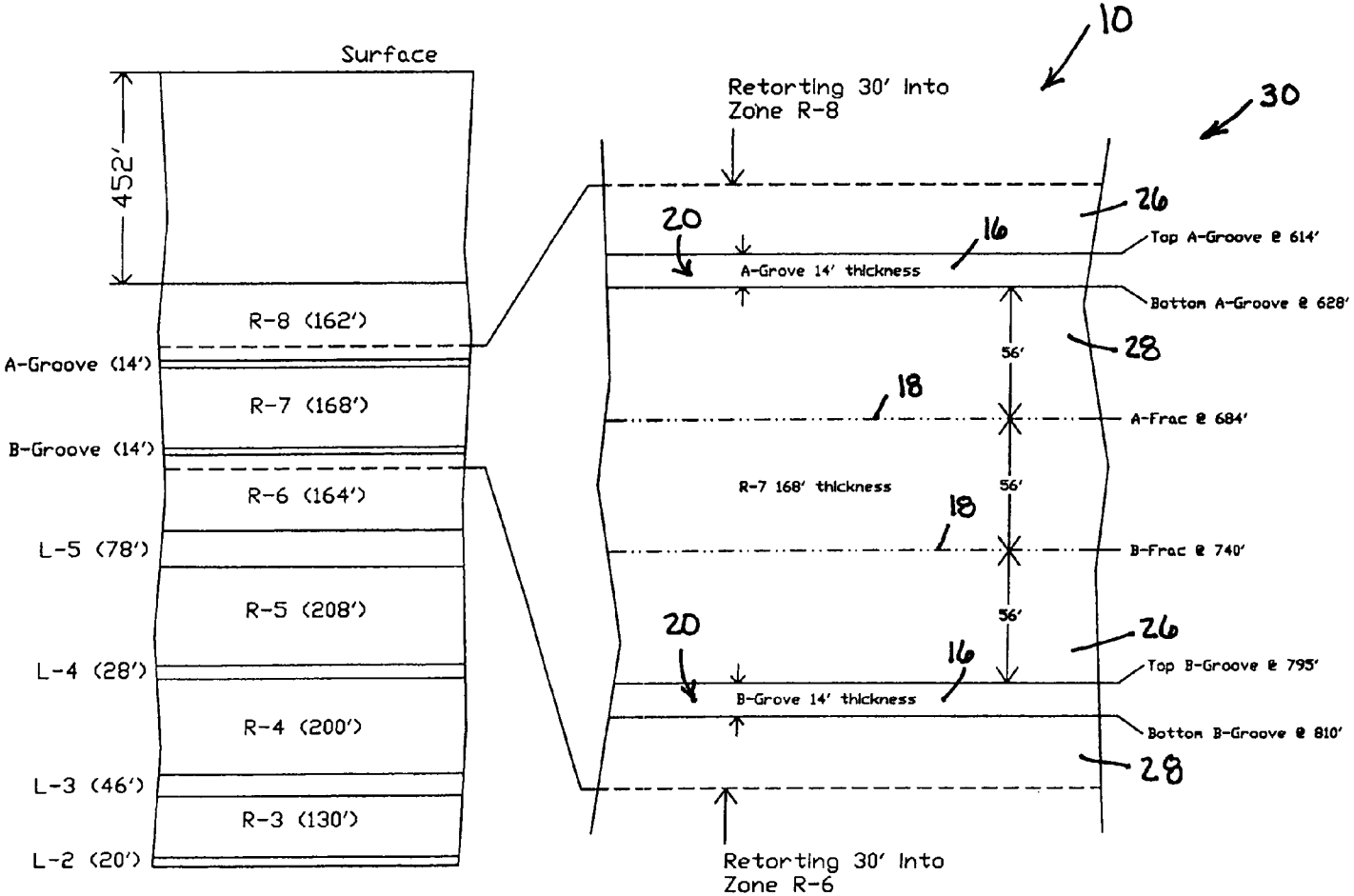
FIG. 2A is a typical cross-section of a stratigraphic column of oil shale zones in the Eureka Creek area, Rio Blanco County, Colo.
Figure 2B:
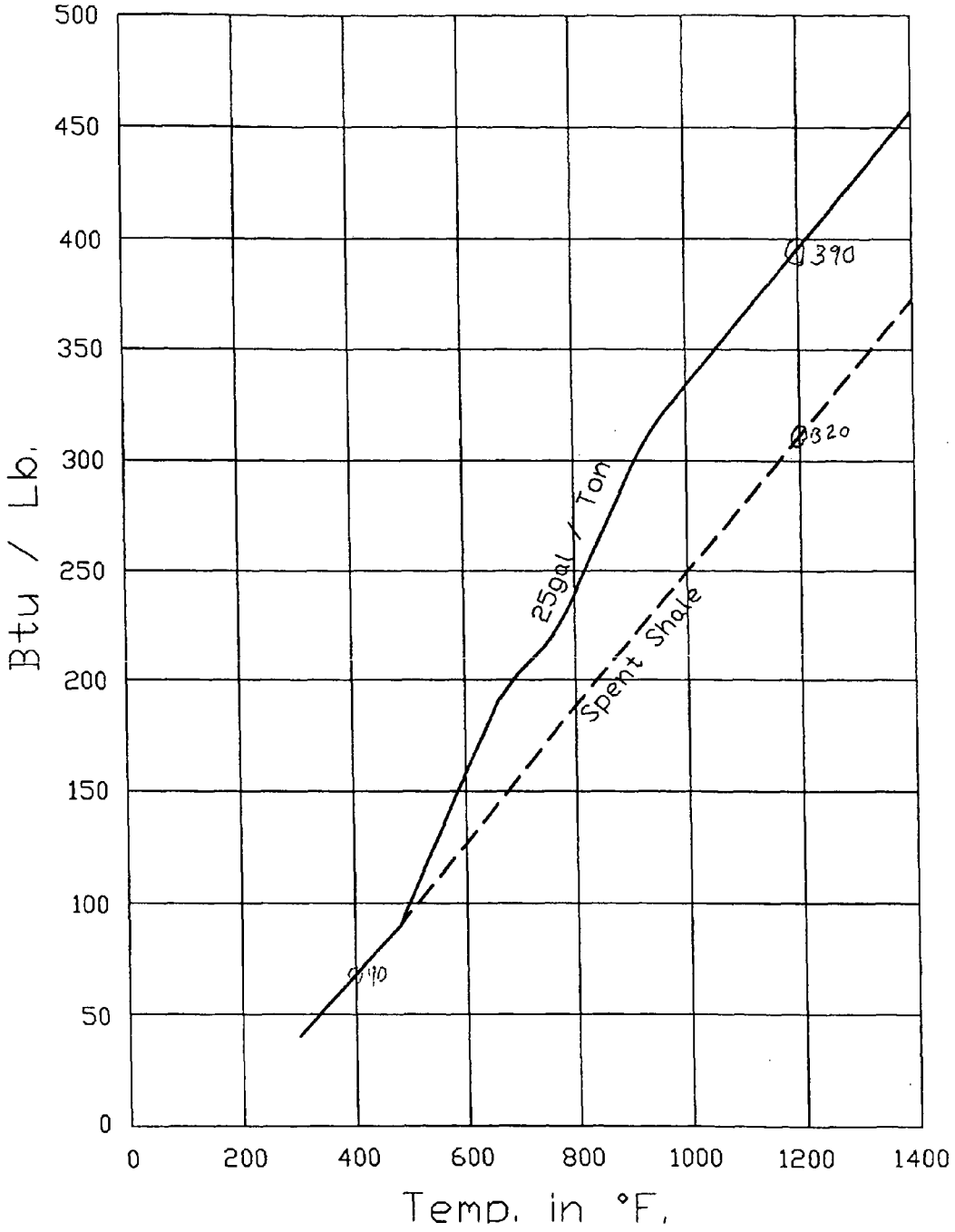
FIG. 2B is a graph of temperature and Btu/lb. of thermal energy required for retorting oil shale.

In FIG. 2, a stratigraphic section, having general reference numeral 30, of the Eureka Creek Area of Rio Blanco County, Colo. is shown. In this illustration, if a vertical distance between adjacent, highly-permeable zones 16 is greater than about 60 ft, then one or more, large, horizontal, hydraulic fracture zones 18, shown as dashed lines, packed with high-permeability, coarse grain (i.e., 10 to 20-mesh or 8 to 12-mesh), will be created at vertical intervals of about 40 to 60 ft and will extend continuously from the line of multiple injection wells 12 to the line of multiple production wells 20, with a space of about ½ mile to 1 mile between such lines of wells. This development will be in the highly-permeable zones 16 of "Groove A" and "Groove B," plus the two sand-packed, highly-permeable, hydraulic fracture zones 18 at about 56-ft intervals between "Grooves A and B,". This pattern of naturally leached, highly-permeable zones 16, plus intermediately spaced, sand-packed, horizontal, highly-permeable hydraulic-fracture zones 18, can be repeated at greater depths for the development of this oil shale resource.

In the development of the highly-permeable zones, a frac-pumping service company can provide integrated contract services for drilling, testing, frac designing, frac pumping, well completion, and evaluation of the completed-well injectivity. This service will be to create adequate TECF injectivity in the naturally occurring highly-permeable zones 16 and also create adequate TECF injectivity through the long, horizontal, propped hydraulic fracture zones 18 in the less-permeable zones. Such long, propped fractures will extend from the line of injection wells 12 to the line of production wells 22 with about ½ mile or greater open space between these lines of wells. This ability to create high-injectivity capacity in each well is a critical aspect in evaluating ultimate well density, production development costs, total economic profit/cost, and environmental acceptability of the subject production system 10.

At a later date, 1-mile-long, horizontal well bores can be drilled horizontally outward from parallel, 2-mile-spaced, road/pipeline right-of-way with the drill sites spaced at 660 ft apart along each road/pipeline right-of-way. The horizontal well bore will be drilled along the middle portion of a high permeability, oil-shale aquifer (i.e., such as the A-Groove or B-Groove. Also, the injectivity of the well bores can be increased by creating a propped, horizontal, hydraulic fracture extending outward from each well bore.

Each injection well 12 will cause the injected hot TECF to flow 660 ft linearly to each of the two parallel, adjacent, horizontal, production wells 22, creating the porous heating element 20, which is 5,280 ft long by 1,320 ft wide, giving an area of 6,970,000 sq ft. The porous heating element 20 causes heat to flow both upward from the 6,970,000-sq-ft, upper-surface area, plus downward from the 6,970,000-sq-ft, lower-surface area, giving a total heating-element surface of about 13,940,000 sq ft from which thermal energy is linearly flowing, by thermal conductivity, into the adjacent, upper and lower less permeable zones 26 and 28. In this configuration, the resulting 13,940,000-sq-ft porous heating element's surface area is about 12,000 times greater than the 1,180-sq-ft porous heating element of a 500-ft-long, well-bore porous heating element. Consequently the injection wells 12 can be injected with about 12,000 times more thermal energy for in-situ retorting of the oil shale hydrocarbons than for a well bore containing a 500-ft-long porous heating element, as used by some prior, in-situ-oil-shale-retorting experiments.

Temperature and Pressure Gradients in Porous Heating Elements with TECF Flow

As the hot TECF flows through the porous heating element 20, it loses heat by thermal conductivity into the adjacent upper and lower less-permeable zones 26 and 28, as illustrated in FIG. 1C. This heat flow from the porous heating element 20 into the adjacent oil shale formations results in a temperature gradient along the TECF flow path in the porous heating element, as conceptually illustrated in FIG. 1B, and with variations thereof as shown in FIGS. 3A and 3B.

Figure 3A:
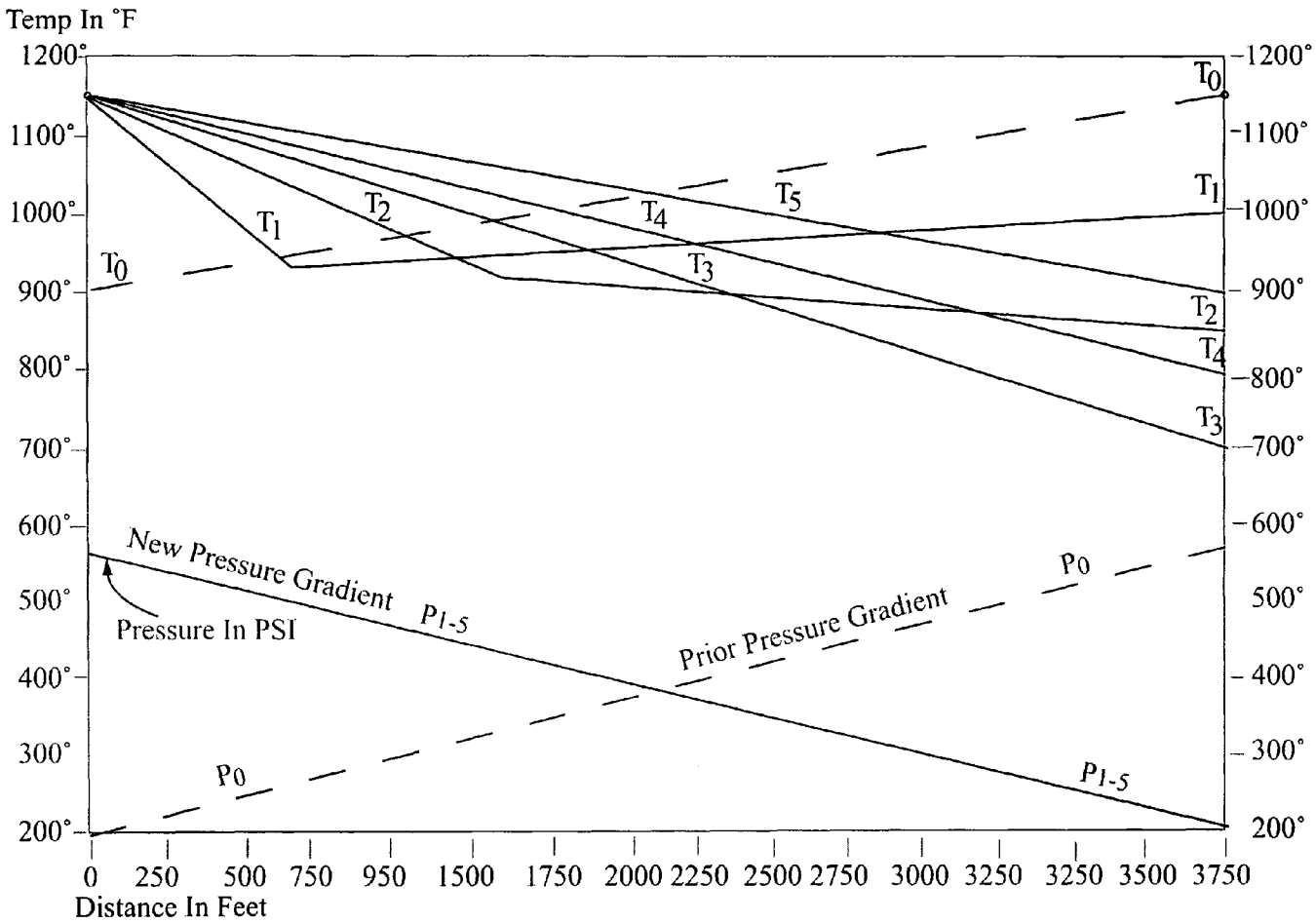
FIG. 3A is a graph of pressure and temperature gradients of the TECF flow through a large, porous heating element created in the highly-permeable zone from an injection well to a production well.
Figure 3B:
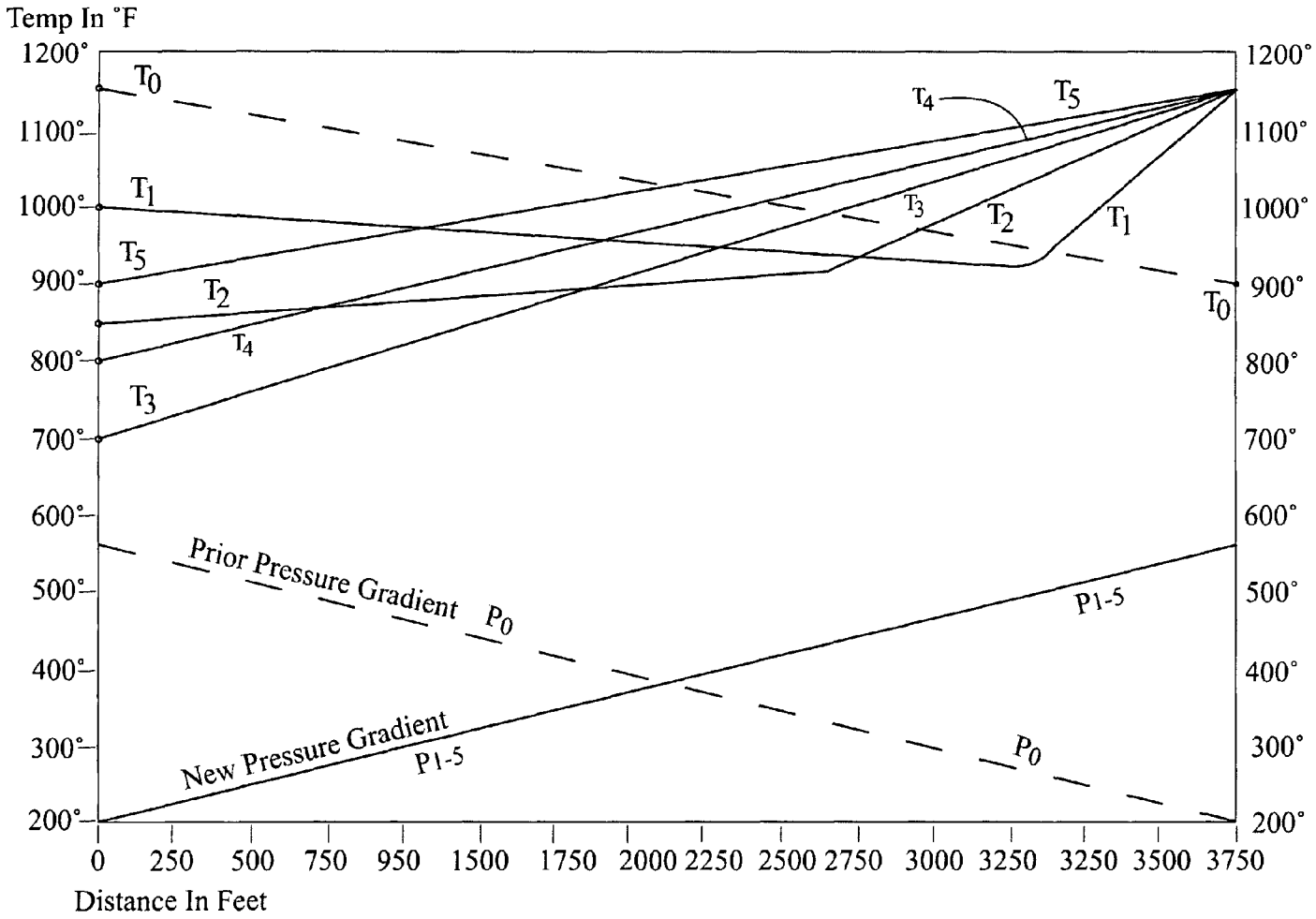
FIG. 3B is a graph of pressure and temperature gradients when the TECF flow is reversed and from the production well to the injection well.

In FIG. 3A, the dashed line from 1,150° F., at the right margin, to 900° F., at the left margin, is a hypothetical temperature gradient in the porous heating element 20 at a time labeled "$t_o$" existing from prior TECF injections. Also, the dotted line, near the bottom of FIG. 3A, represents a pressure gradient "$p_o$" at the time labeled "$t_o$" previously existing during the prior TECF injection. The solid line, near the bottom of FIG. 3A, represents a pressure gradients "$p_{1-5}$" after reversal of the TECF injection and during the subsequent times of $t_1$, $t_2$, $t_3$, $t_4$, and $t_5$.

Also in FIG. 3A, the TECF flow direction is shown reversed from the prior flow direction from right to left to a new flow direction from left to right. Soon after reversal of TECF flow direction, at a time labeled $t_1$, the temperature profile between the line of injection wells 12 and the line of production wells 22 can be approximately as shown by the solid line labeled $t_1$. Later, at a time labeled $t_2$, the temperature profile can be approximately as shown by the solid line labeled $t_2$. Then at a later time labeled $t_3$, the temperature profile can be about as shown by the solid line labeled $t_3$. At subsequent times of $t_4$ and $t_5$, the temperature profiles will gradually change to approximate the solid lines labeled $t_4$ and $t_5$ respectively. Subsequently, when the production well bottom hole temperature reaches a value selected by a field operator, the TECF flow direction is reversed again to flow from right to left to produce the sequence of temperature profiles labeled $t_1$, $t_2$, $t_3$, $t_4$, and $t_5$ at such sequence of time intervals as shown in FIG. 3B. These TECF flow direction reversals will be continued for the life of economic production of those wells completed in this oil shale zone.

Thermal-Conductivity Heat Flow from TECF Porous Heating Elements into Adjacent Rock Formations FIGS. 4A, 4B, 4C, 4D and 4E show a progression, with time, of the temperature profiles in the upper and lower less-permeable zones 26 and 28 above and below the porous heating element 20 in the highly-permeable zone 16. The temperature profiles resulting from the thermal conductivity heat flow away from the heating element. The dotted lines represent the temperature profile if the thermal conductivity remains nearly constant at about 1 Btu/hr/ft$^2$ at a temperature gradient of 1° F./ft (i.e., 1 Btu/hr/ft$^2$/1° F./ft). Note that the advancing retort-front is located where the temperature is about 500° F.

The retorted hydrocarbons created at or near the advancing retort-front will flow toward the porous heating element 20 and through zones of progressively higher temperatures. At these higher temperatures (i.e., from 750° F. to 1,200° F.), the retorted product will undergo further thermal cracking (i.e., coking) which deposits carbon on the mineral grain surfaces (i.e., on the pore space walls). With this progressively increasing temperatures and very long residence time (i.e., many months), these carbon deposits on the retorted oil shale pore-space walls will crystallize into various forms of graphite, buckeyballs, buckeytubes, buckminsterfullerenes, carbon fibers, carbon tubes and other crystallized forms of carbon which have greatly increased thermal conductivity and electrical conductivity.

Figure 4A:
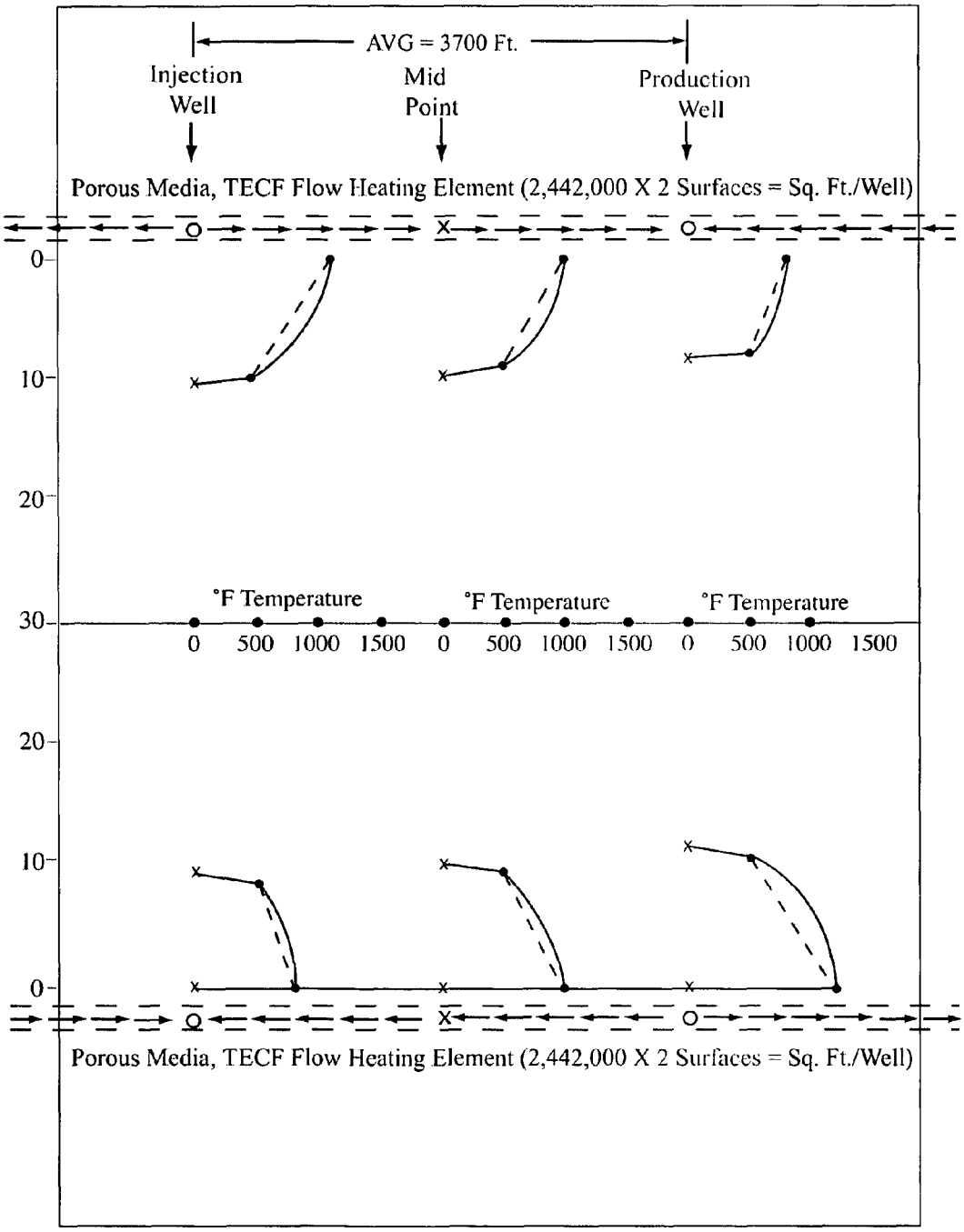
FIGS. 4A, 4B, 4C, 4D, and 4E illustrate progression, with time, of the temperature profiles in the less-permeable, oil shale formations above and below the porous heating element created in the highly-permeable zone.

Consequently, the thermal conductivity in these high temperature, thermal cracking locations can increase to 5 or 10 times the normal low temperature, pre-retorted, oil-shale rocks' thermal conductivity. The temperature gradients in this higher temperature, increased thermal conductivity, retorted rock formations can be approximately as illustrated by the solid lines in FIGS. 4A-4E. This increase of thermal conductivity results in a lower temperature gradient in the high conductivity zone compared to temperature gradients in the low conductivity zones, as illustrated in FIGS. 4A-4E. Consequently, the series of solid lines in FIG. 3A, labeled $t_1$, $t_2$, $t_3$, $t_4$, and $t_5$, represents the probable temperature profile of the TECF flowing through the porous heating element 20, and the solid lines in the top half of FIG. 4A shows the probable temperature profile of the thermal conductivity heat flow downward, away from this porous flow porous heating element. Note in FIG. 4A that in the high temperature, high thermal conductivity, intense thermal cracking, retorted zone, the temperature gradient is very low compared to higher temperature gradient in the lower temperature, lower thermal conductivity zone near the downward advancing retort-front.

Figure 4B:
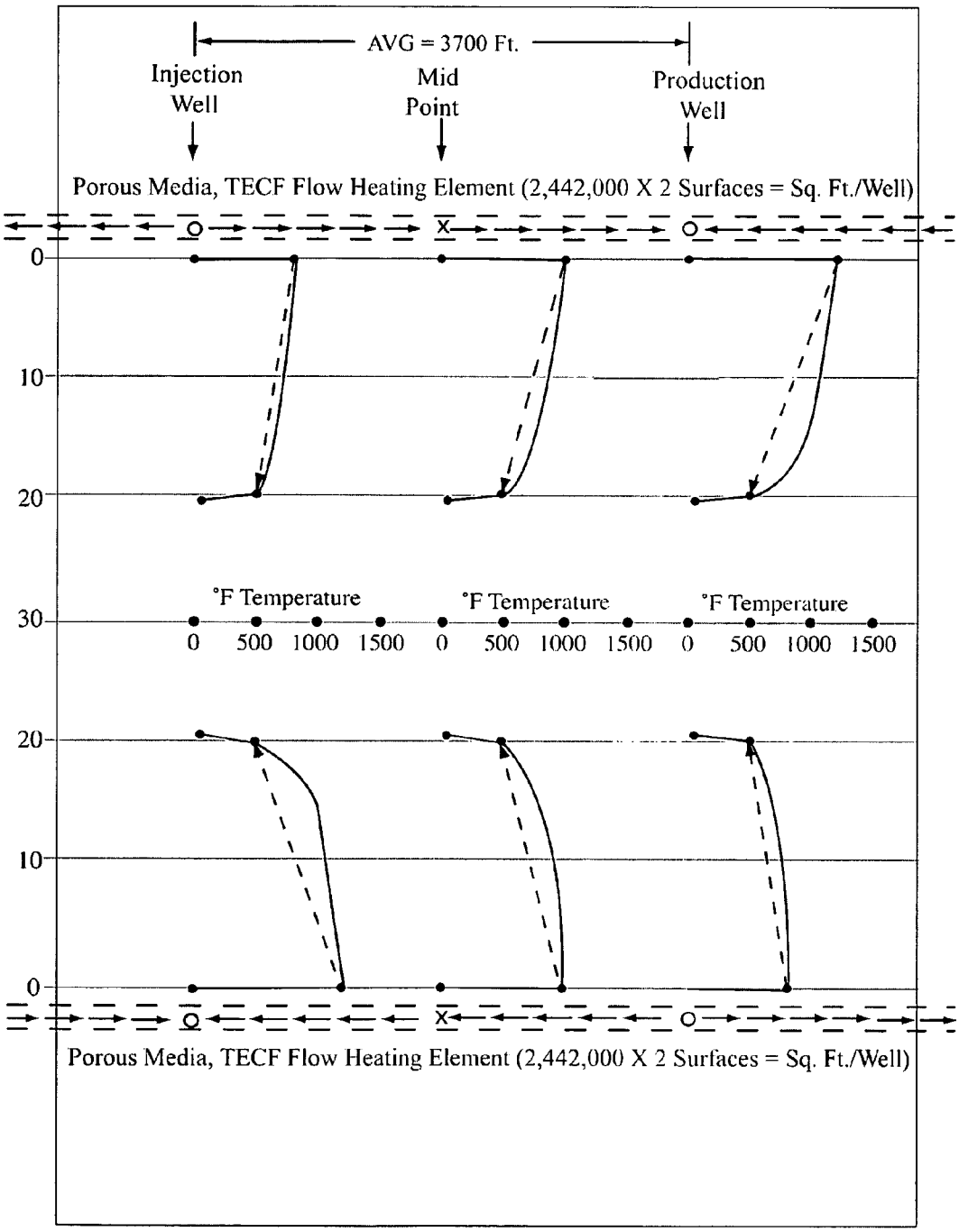

The lower portion of FIG. 4A represents the TECF flow in the lower portion of the porous heating element 20 from right to left, which is opposite to the TECF flow direction in the upper portion of the porous heating element depicted in the upper portion of FIG. 4A and as described above. In FIGS. 3B and 4B, the TECF flow directions are the reverse of the TECF flow directions shown in FIGS. 3A and 3B. In the same manner, the FIGS. 4A-4E show the TECF flow reversal between each successive figures and also show advancing time intervals with advancing penetration of the retort-front from each porous heating element 20 in the succession of these figures.

The approximate thermal conditions illustrated in FIGS. 3 and 4 will occur in the center portion of a unitized in-situ retorting area at least 1½ miles away from its outer unretorted perimeter and after the thermal conductivity advancing retort front has penetrated several feet (i.e., preferably 5 or more feet) away from each TECF injected porous heating element 20. In the earlier portion of the retorting process history and within 1 to 1½ miles of the outer retorted perimeter of the unitized in-situ retorting area, the TECF flow dynamics and thermal conductivity changes and are much more complicated and cannot be simply interpreted as depicted in the series of profiles shown in FIGS. 3 and 4.

Figure 4C:
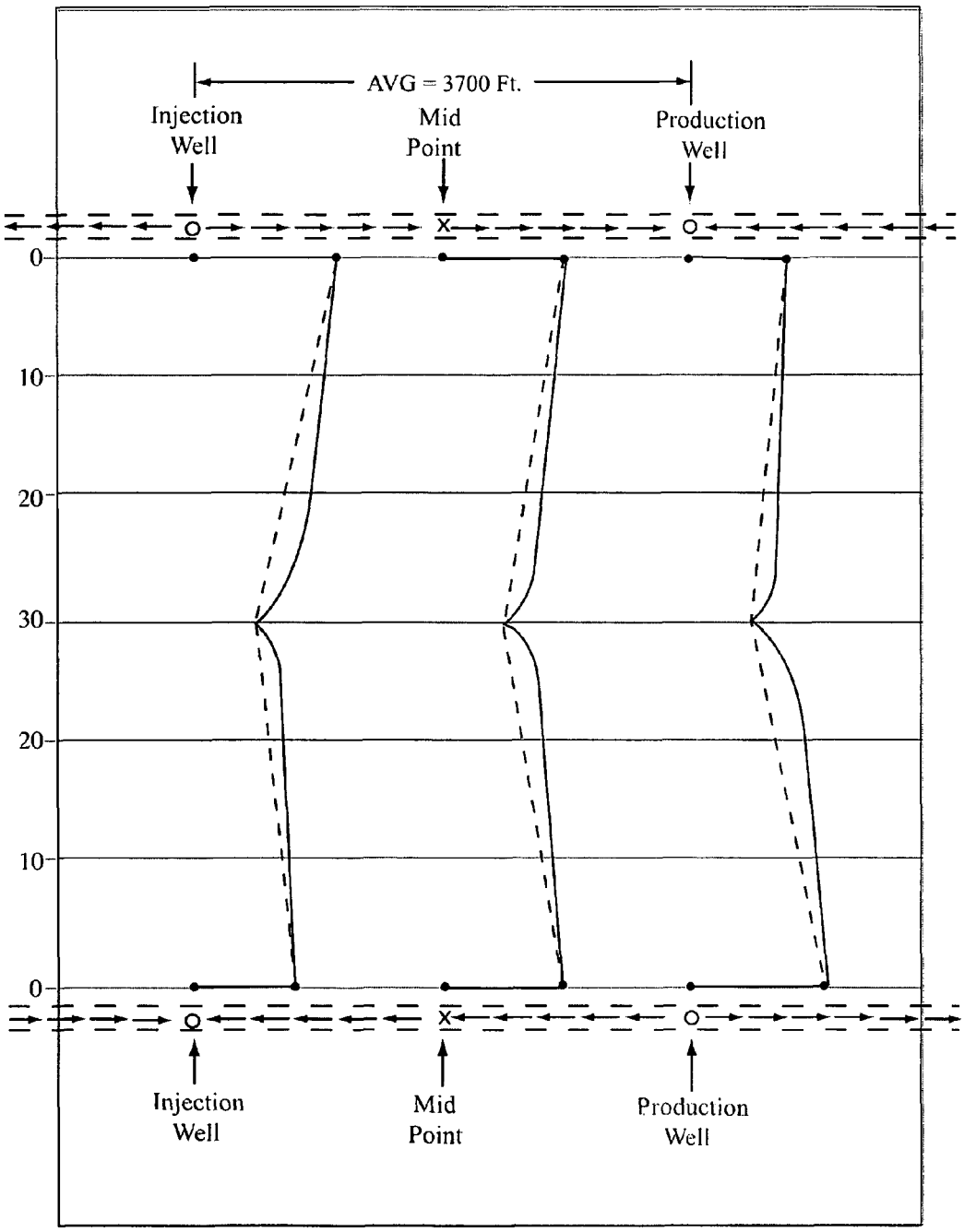
Figure 4D:
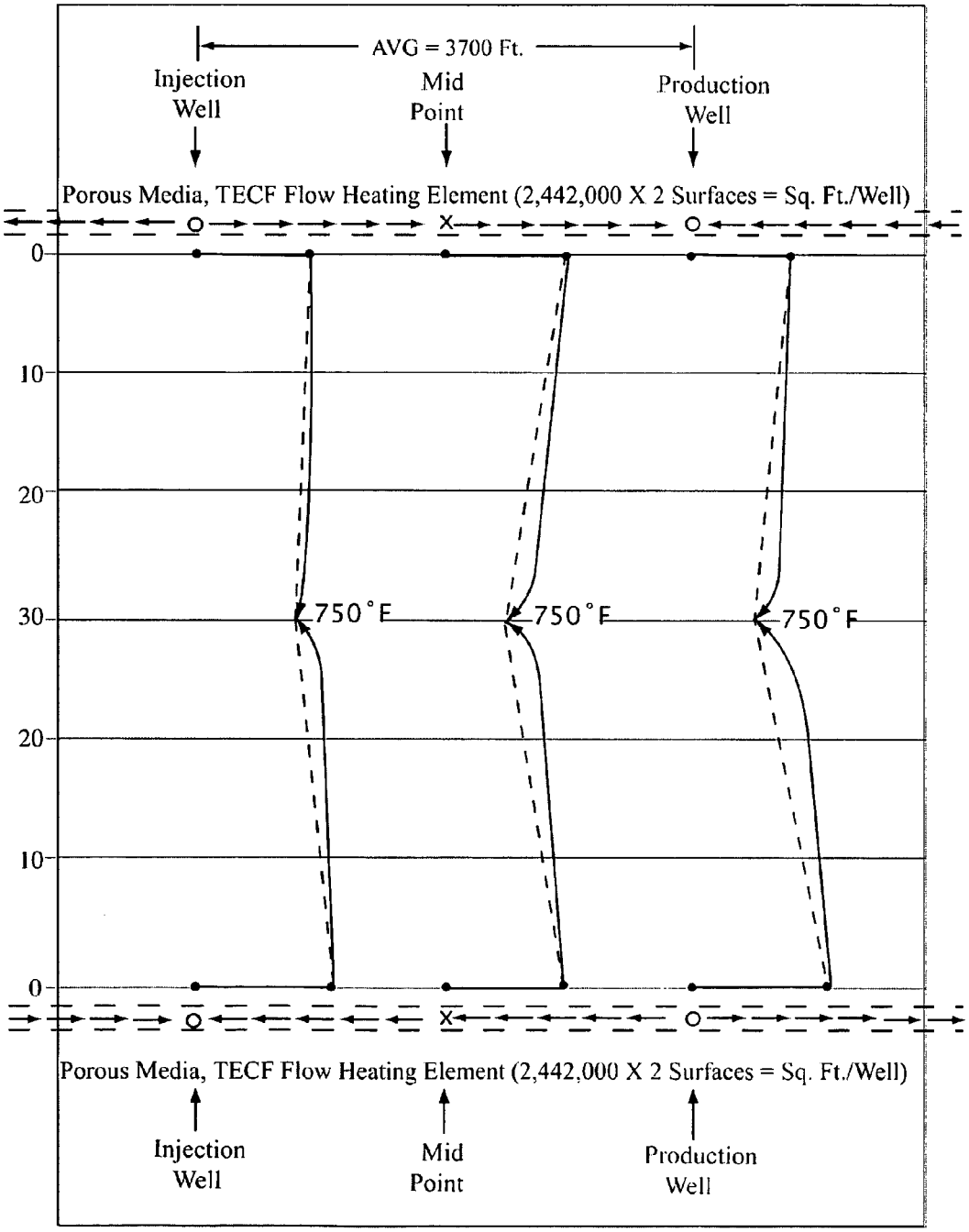
Figure 4E:
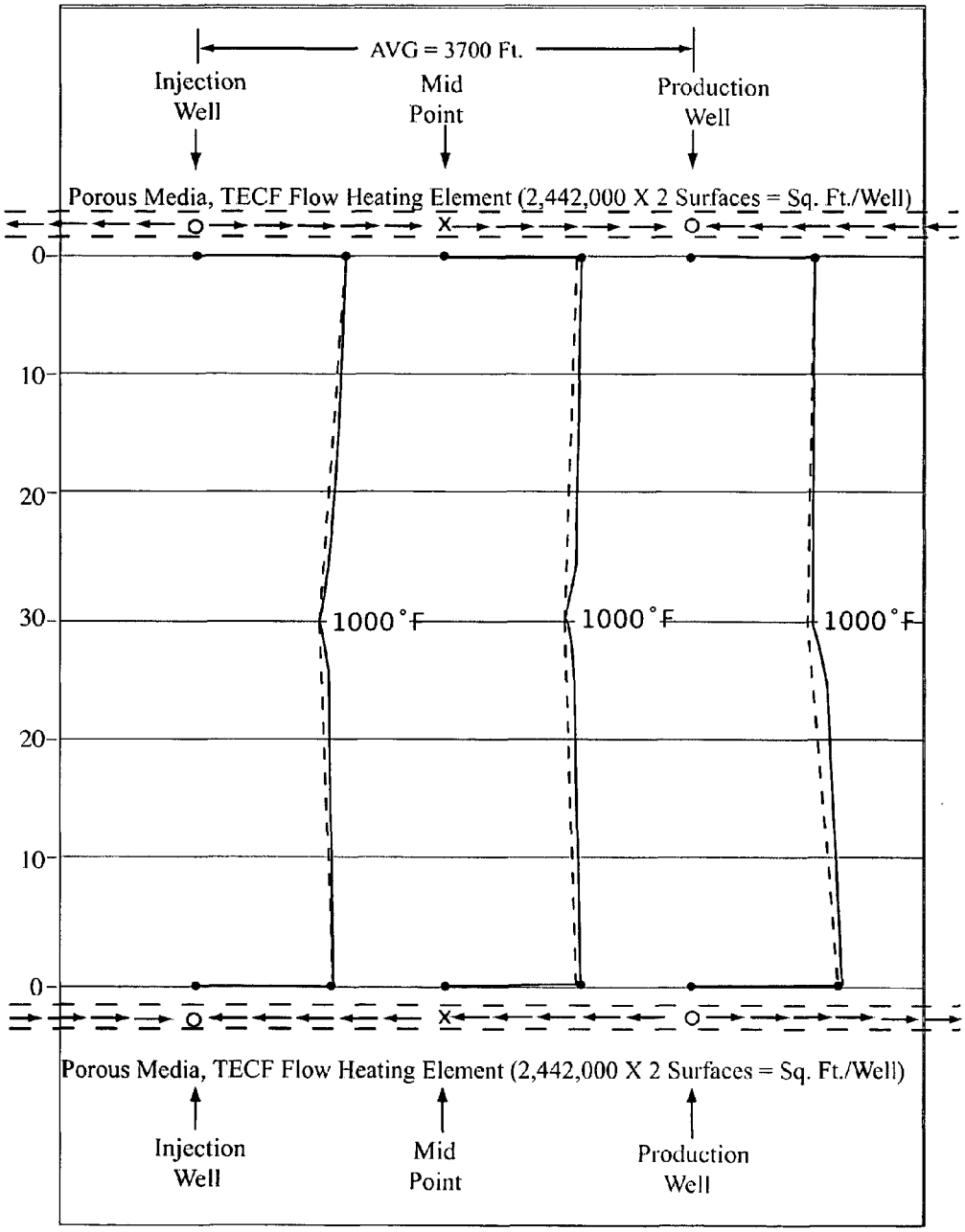
Figure 4F:
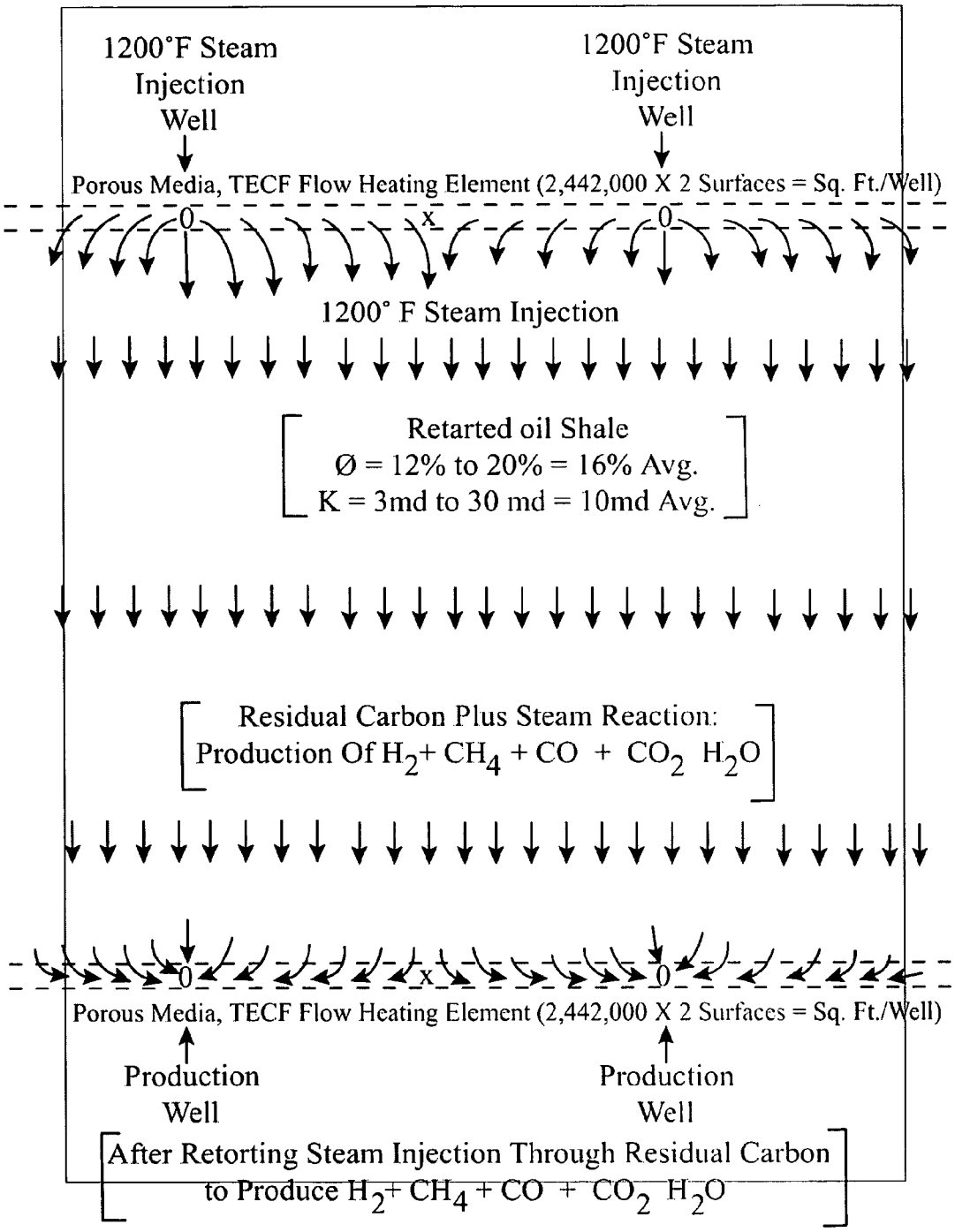
FIGS. 4F and 4G illustrate the injection of superheated steam in the porous heating element for retorting residual carbon deposited on the pore-space walls in the highly-permeable zone between the injection wells and production wells.
Figure 4G:
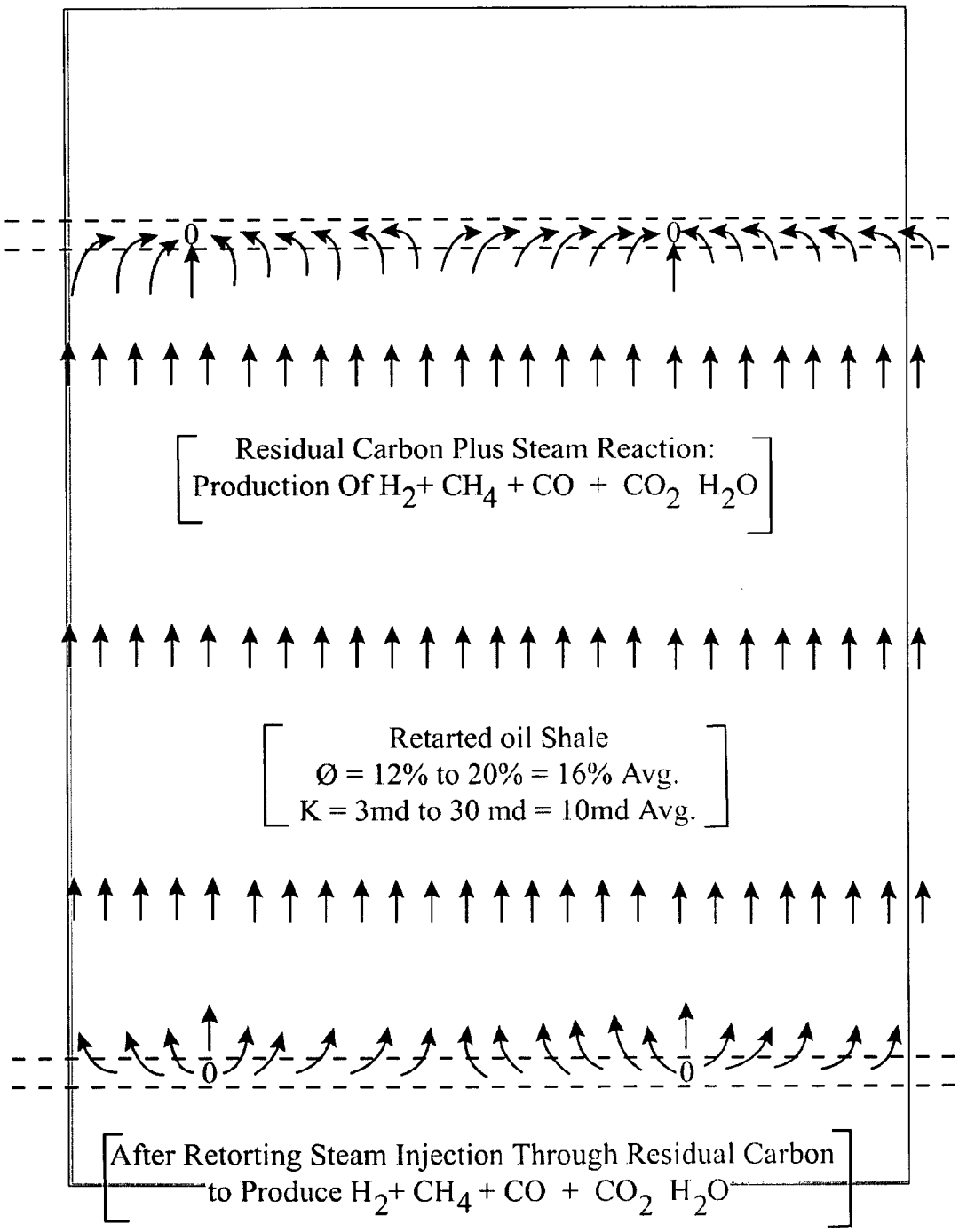

After the total 60-foot interval between the two porous highly-permeable zones 16 has been fully retorted as illustrated in the example shown in FIG. 4C, then the residual carbon deposited on the pore-space walls can be removed by reaction with injected superheated steam, as illustrated in FIGS. 4F and 4G. After retorting, the spent oil-shale rock formations can have a permeability ranging from about 3 md to 30 md and probably averaging about 10 md.

The art of synthesis gas generation is well known in coal gasification. Similar methods can be employed hereunder to recover energy products and water from the carbonized, late-stage residue of the in situ porous heating element. For example, superheated steam, at temperatures greater than 900 degrees F., preferably in a range of 1000 to 1400 degrees F., and more specifically about 1200 degrees F. can be caused to flow from the upper portion of the porous heating element 20 and through the 10 md retorted oil-shale rock formations and down into the lower porous heating element 20, as shown in FIG. 4F. Subsequently, the flow direction can be reversed as shown in FIG. 4G. In this process the superheated steam will react with the residual carbon in the hot retorted oil-shale rock formations to produce a product mixture of $H_2$, $CH_4$, CO, $CO_2$, and $H_2O$. The produced water can be selectively separated from the non-condensable $H_2$, $CH_4$, CO energy product stream by condensation. This provides one of several methods whereby the instant production system can be beneficially employed for the production of high purity water. Others are illustrated elsewhere herein. FIGS. 4F and 4G illustrate the removal of carbon that can be achieved in the hot retorted oil shale rock through the reaction with superheated steam.

In Situ Water Purification

The instant invention provides the means to create a wide range of energy and petrochemical products from fixed-bed carbonaceous deposits. In particular, the in situ porous heating element provides an operational element that is useful in the production of a wide range of products from oil shale and other fixed-bed hydrocarbons and carbonaceous geological resources. For example, the carbonaceous deposit left behind following a successful oil shale retorting operation is a highly enriched, carbon adsorptive surface.

In one embodiment, the methods of the present invention can be used directly for large-scale water purification. In one purification mode, the purification can be via adsorption of solutes in a water stream to a carbon-rich, adsorptive surface. In another mode, water purification occurs prior to formation cool-down by simple distillation of mineral-rich formation waters to produce reduced-solute water at the surface. Such distillation can be achieved by conducting formation water from the perimeter or other low temperature areas of a formation into a high temperature zone created, for example, by prior retorting and/or in situ heating element activity. The water is provided the means to: a) enter such high temperature zone(s) and b) circulate through such a zone(s) to a collection point; and c) be distributed to one or more geological or surface locations. The vapor conducted to the surface can be condensed as high purity water and used as a surface water supply for a variety of purposes including municipal, industrial, reservoir development or environmental enhancement purposes. Water high in mineral content can be conducted to the formation from considerable distances to undergo substantial desalinization and/or purification using the methods of this invention. Also, water contaminated with organic materials can be beneficially purified using the methods of this invention, by adsorption, distillation, reactive decomposition (e.g. of organic materials), or any combination thereof. Simple heating to vaporization followed by condensation is effective in reducing mineral content in highly mineralized water. It is also sufficient to remove or mineralize some organic matter either directly or by decomposition. However, an additional in situ purification step can be added when purifying water containing one or more unwanted organic solutes. Such water can be injected into the formation to encounter the in situ carbon-rich adsorption surface, followed optionally by circulation through the high temperature, highly-permeable zone where vaporization occurs.

As described elsewhere, carbon-rich residue and surfaces are common in the late-stage in situ heating. Such surfaces provide an ideal matrix for reducing organic content in water injected into a formation through an injection well. Typically, such high-carbon surfaces can be found in an in situ heating element that has begun the cooling cycle. The enhanced water purification method comprises circulating injected water through a high-carbon adsorption area and one or more heated zones sufficient to vaporize the water. The water vapor is then produced at the surface through one or more production openings and, typically, conducted to one or more condensing surfaces and/or collection vessels.

Electrical Power Generation

Heat remaining in rock formations following in situ retorting activity also can be partially recovered by injecting cold water and producing steam to generate electricity or other shaft horsepower work by flowing through steam turbines or other gas expansion systems.

In one embodiment, the present invention provides for the generation of electrical power. In this embodiment, the thermal energy carrier fluid is injected into a formation through one or more injection openings, circulated in situ so as to contact at least one heated fixed-bed carbonaceous deposit with sufficient heat to cause substantial vaporization of the TECF, and further producing heated TECF through one of the production wells, and providing a means of transferring thermal energy and/or pressure from the TECF, directly or indirectly, to an electrical power generating turbine. In this method, energy in the form of heat and/or pressure that is stored in an established in situ, porous heating element or a previously heat-treated carbonaceous deposit is transferred in the form of heat and/or pressure, by means of the TECF, from the formation to the surface. At the surface, such energy is used, directly or indirectly, to turn one or more electrical power generating turbines. By way of example, the TECF can be injected from the surface through an opening in the formation and circulated into one or more of the highly-permeable zones that are operationally connected to one or more porous heating elements. The permeability can be naturally occurring, or artificially created, as by previous in situ retorting or in situ refining activity. Injected TECF can be heated to the point vaporization, and optionally superheated, and provided with one or more high velocity egress path that is operationally linked to a surface electrical power generating operation. In one embodiment, the egress path is directly linked to an expansion chamber that drives an electricity-generating turbine. In another embodiment, at least a portion of the energy contained in the TECF is transferred through a heat-exchange interface to a secondary substance (e.g. steam) that is operationally linked to one or more electricity-generating turbines.

The heating, expansion, and cooling of the TECF vapor can be integral components of the surface electrical power generating activity. Alternatively, the components can serve as a pre-heating or optional heat-assist loop in an operationally linked but more traditional, closed-loop steam-based electrical power generating cycle. In either model, the cooled vapor or condensate remaining after the expansion or heat transfer step can be beneficially employed in another cycle of heating and cooling by re-injection into the heated formation in a manner essentially identical to that described in the first step. The process of injection, heating, expansion, cooling can be repeated indefinitely until the temperature of the formation no longer supports vaporization of the injected TECF.

Energy Balance in the System

Of the 390 Btu/lb of TECF thermal energy injected into the in-situ porous heating element 20 used in retorting, about 70 Btu/lb (i.e., 18%) is used in actual kerogen retorting, about 250 Btu/lb (i.e., 64%) is recovered as heat in post retorting steam generation, and about 70 Btu/lb (i.e., 18%) is left as residual heat in the retorted rock formations after abandonment. The fossil fuel energy content of the produced, retorted products is about 25 gallons of oil equivalent per ton of oil shale, or about 1,687 Btu/lb of oil shale. This is about 4.3 times the total energy initially used in retorting (i.e., 390 Btu/lb), or about 12 times the non-recoverable, residual heat energy (i.e., 70 Btu/lb) left in the retorted rock formations after abandonment. In other words, the thermal energy used in retorting is about 23% of the produced retorted products, and, after recovery of about 60% of the thermal energy in the spent oil-shale rocks, the net thermal energy used in this operation is about 8.3% of the recoverable retorted products.

Retorted Oil Shale Products Controlled by Two-Phase Flow in Porous Heating Element A two-phase flow of vapors (gases) and hydrocarbon liquids through the porous heating element 20 results in low viscosity vapors flowing at a very high velocity with very short residence time, and high viscosity hydrocarbon liquids flowing at a very low velocity giving them very long residence time in the high-temperature, porous heating element 20 to undergo further hydrocracking. As the high-viscosity hydrocarbon liquids flow slowly through the high temperature (i.e., 800° F. to 1,200° F.) porous heating element 20, hydrocracking will transform these high molecular weight liquids into residual carbon plus lower molecular weight vapors, which then flow rapidly toward the line of producing wells.

FIGS. 5A-5E illustrate the boiling point pressure vs. temperature graphs of the retorted-hydrocracked hydrocarbons flowing through the high-temperature, porous heating element 20. The upper and lower dashed lines show the approximate pressure/temperature values of the retorted products and TECF flowing through the porous heating element 20 from the injection well pressure/temperature on the right to the production well pressures on the left. Note that on each figure, the upper dashed line goes to the proposed 900° F. maximum producing well temperature, and the lower dashed line goes to the proposed 700° F. minimum producing well temperature. Intermediate dashed lines can be drawn for intermediate temperatures at the production well 22.

The heat of vaporization or the heat of condensation will cause small variations of these dashed lines where significant vaporization or condensation is occurring. Vaporization, absorbing heat, is occurring where the dashed line in the flow direction (i.e., right to left) crosses the solid lines to progressively larger molecules (i.e., higher number of carbon atoms) and condensation, releasing heat, is occurring where the dashed line in the flow direction crosses the solid line to progressively smaller molecules (i.e., lower number of carbon atoms).

Figure 5A:
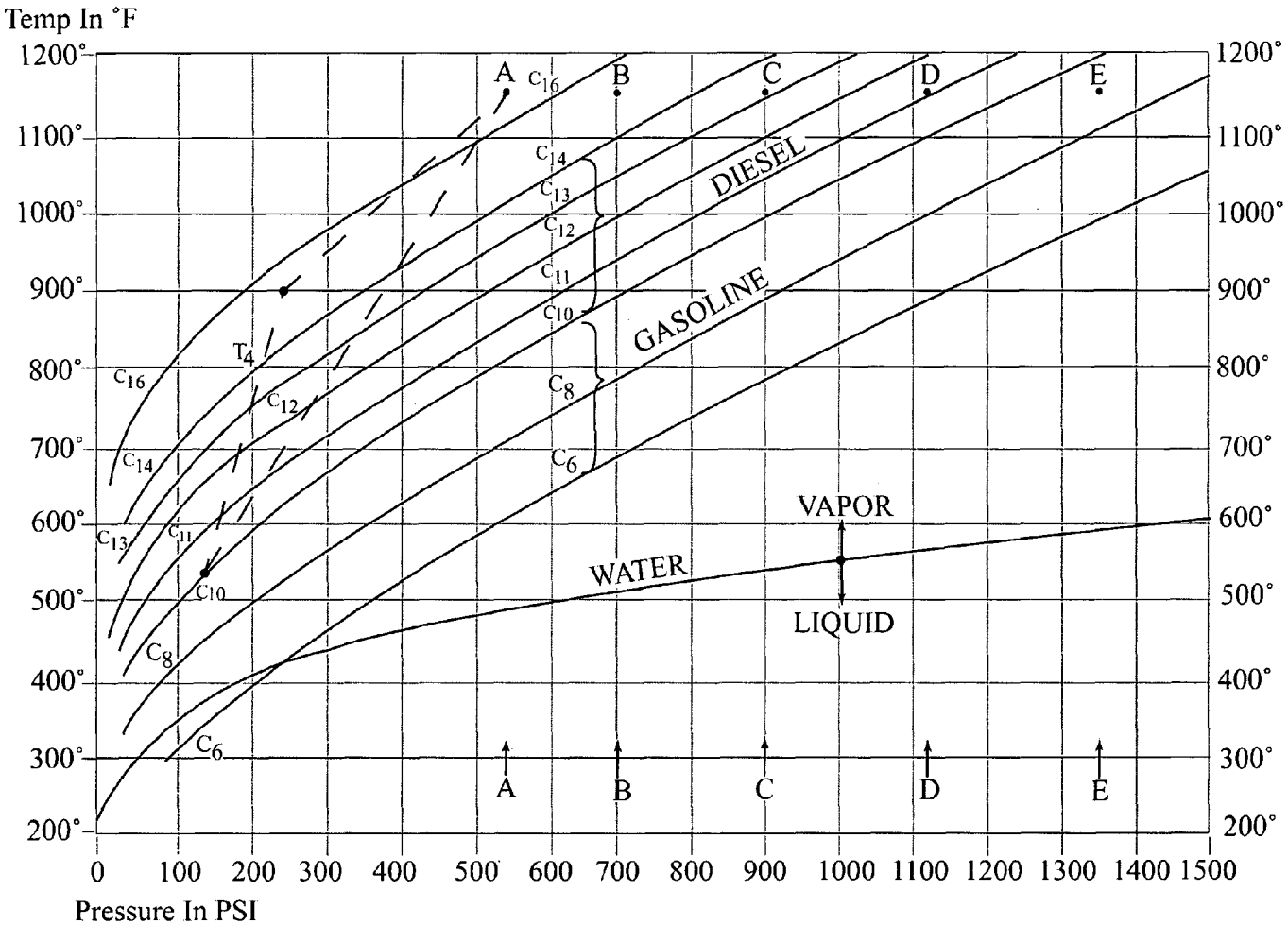
FIGS. 5A, 5B, 5C, 5D and 5E illustrate graphs of the temperature and pressure of the retorted hydrocarbons flowing through the porous heating element.

FIG. 5A represents retorting into the porous heating element 20 at about 620-foot depth at 560 psi injection pressure, wherein all hydrocarbon molecules bigger than $C_{16}$ will be liquid flowing slowly, with long residence time, resulting in continued hydrocracking and refining of the hydrocarbons. When the production wells 22 are at lower temperatures (i.e., near 700° F.=lower dashed line), condensation will be creating liquids of $C_{14}$, $C_{13}$, and $C_{12}$ in the latter part of the porous media flow path into the production well 22 at lower temperatures, resulting in some additional hydrocracking.

Figure 5B:
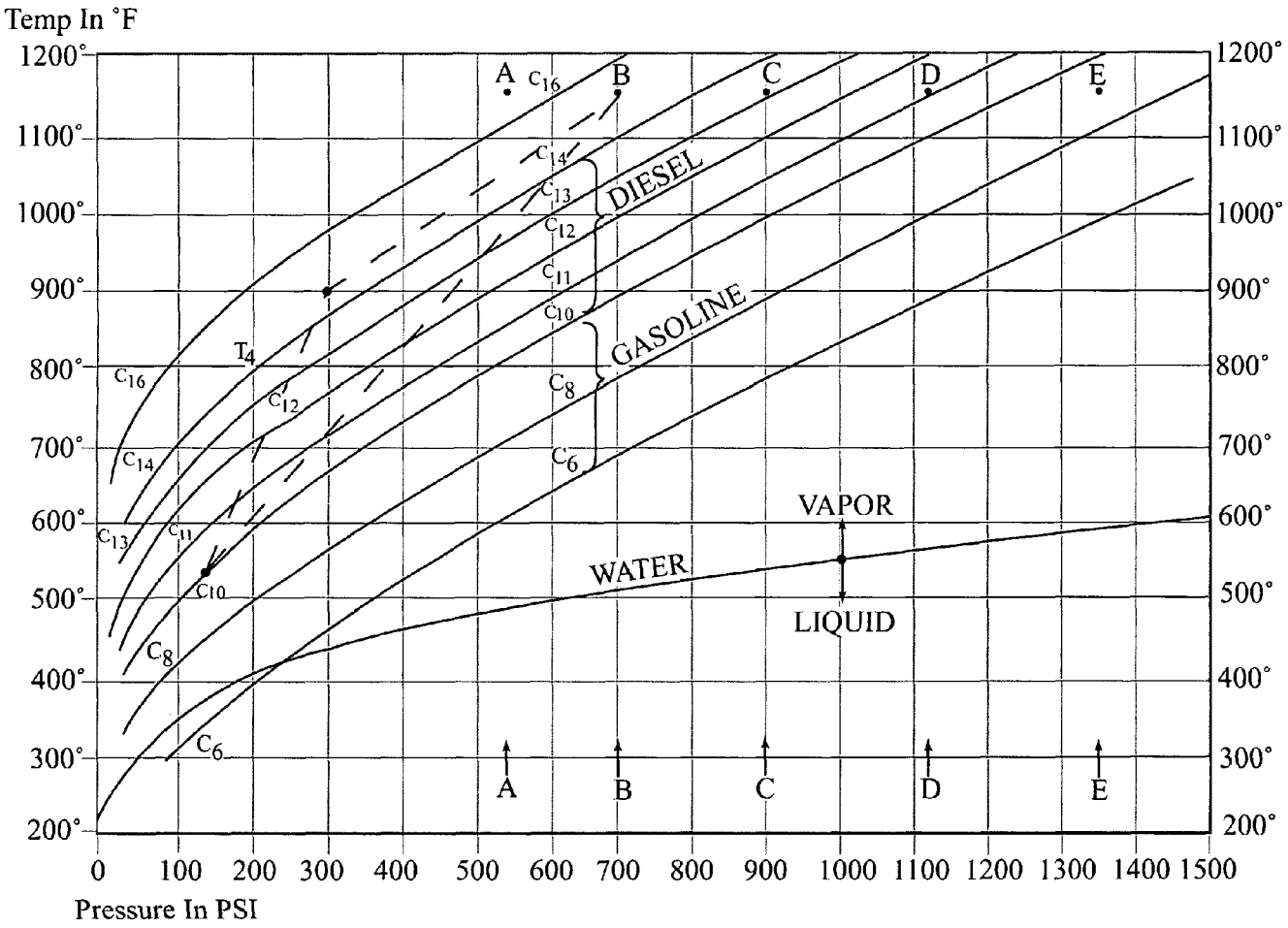

FIG. 5B represents retorting into the porous heating element 20 at about 800-foot depth at 690 psi injection pressure, wherein all hydrocarbon molecules bigger than $C_{15}$ will be liquid with long residence time for continued hydrocracking. When the production wells 22 are at a lower temperature (i.e., near 700° F.=lower dashed line), condensation will be creating liquid $C_{14}$, $C_{13}$, and $C_{12}$ in the latter part of the porous media flow path into the production wells 22 at lower temperatures, resulting in additional hydrocracking.

Figure 5C:
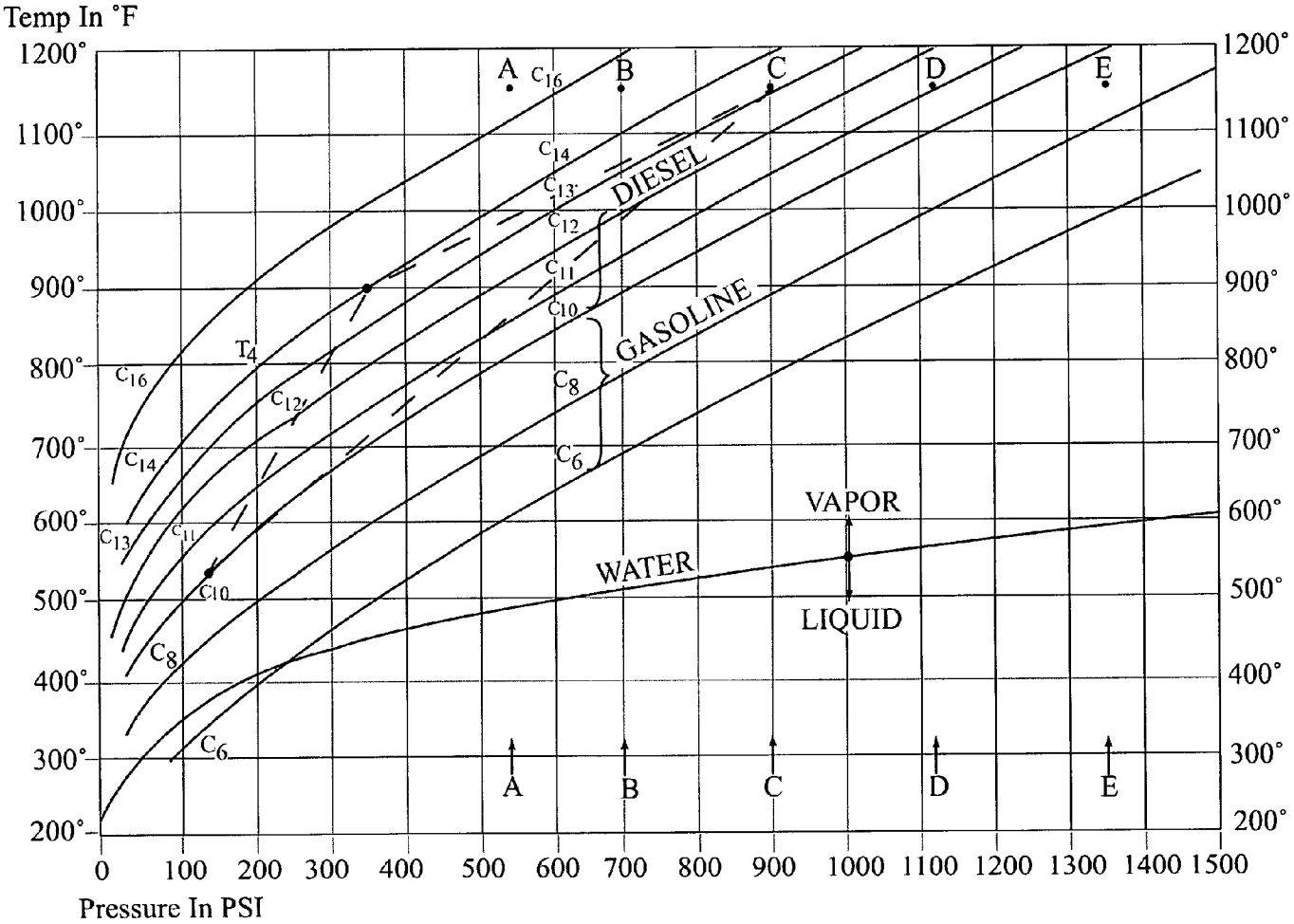

FIG. 5C represents retorting into the porous heating element 20 at a depth of about 1,000 feet at a 900 psi injection pressure, all hydrocarbon molecules bigger than $C_{13}$ will be liquid with long residence time for continued hydrocracking. When the production wells 22 are at a lower temperature (i.e., near 700° F.=lower dashed line) condensation will be creating liquid $C_{12}$ and $C_{11}$ in the latter part of the flow path into the production wells 22 at lower temperatures, resulting in additional hydrocracking.

Figure 5D:
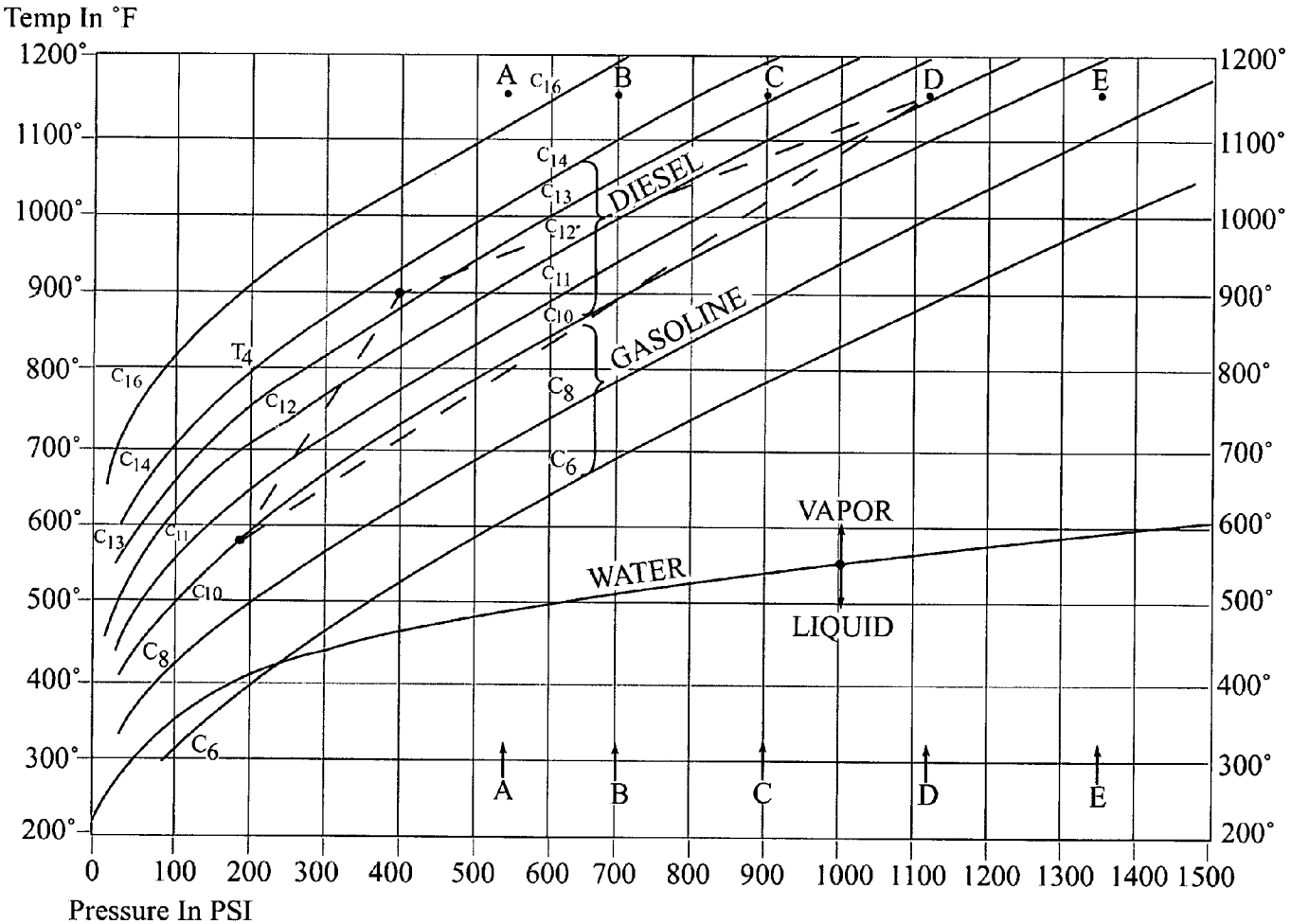

FIG. 5D represents retorting into a porous heating element at a depth of about 1,250 feet at a 1,125 psi injection pressure, all hydrocarbon molecules bigger than $C_{11}$ will be liquid with long residence time for continued hydrocracking. When the production well temperatures are at the higher operating temperatures (i.e., near 900° F.=upper dashed line), evaporation will be creating vapors of $C_{12}$, $C_{13}$, and $C_{14}$ in the latter part of the flow path into the production wells 22. Prior to this vaporization and in the non-vaporized components, significant hydrocracking will have taken place in the earlier portion of the flow path away from the line of high temperature injection wells 12. When the production wells 22 are at the lower temperature values (i.e., 700° F.=lower dashed line) neither evaporation nor condensation is taking place along the porous element flow path so that all hydrocarbon molecules bigger than $C_{11}$ remain liquid and all smaller hydrocarbon molecules remain in their vapor phase.

Figure 5E:
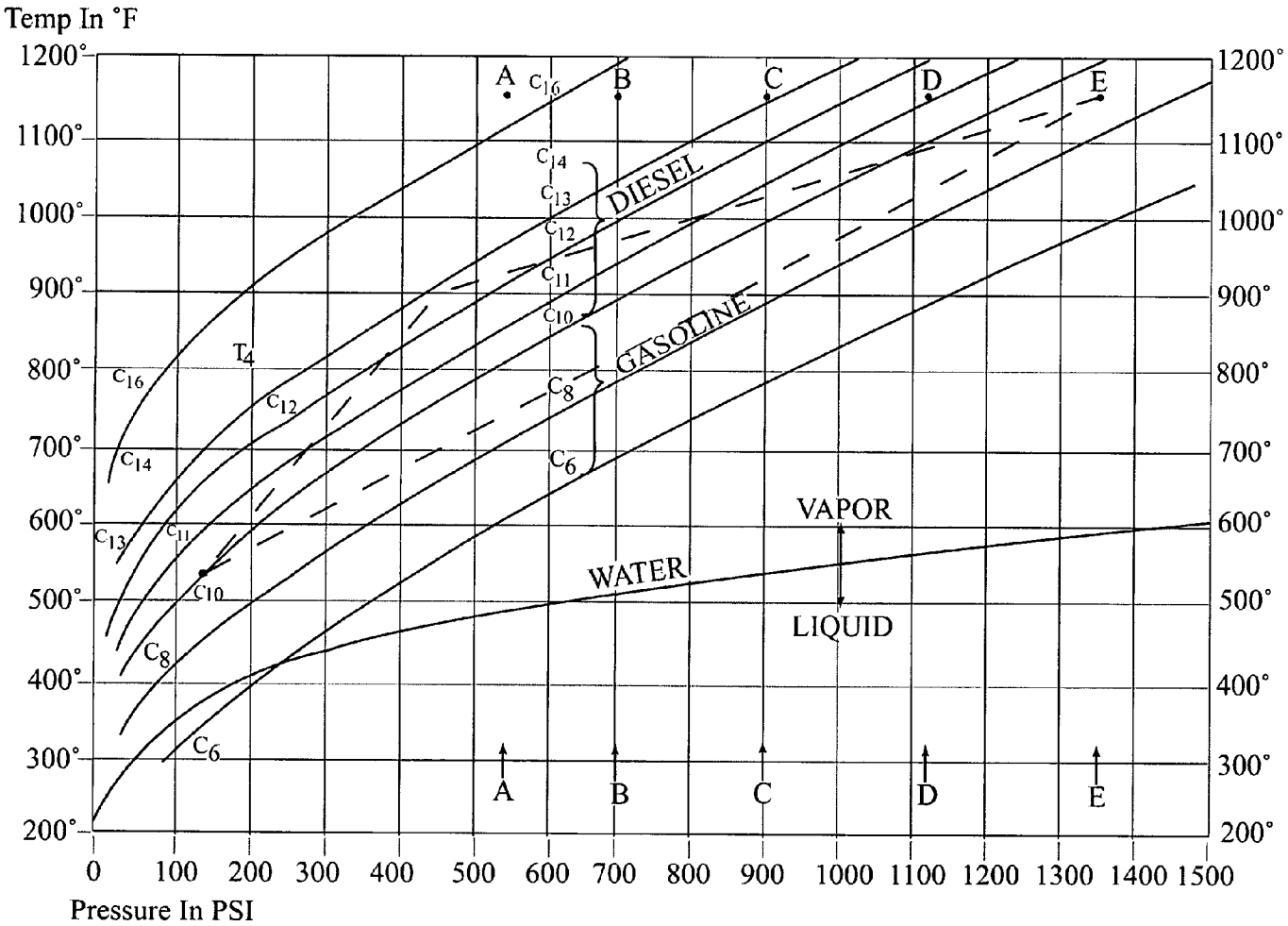

FIG. 5E represents retorting into the porous heating element 20 at a depth of about 1,500 feet at a 1,350 psi injection pressure, wherein all hydrocarbon molecules bigger than $C_9$ will be liquid with long residence time for continued hydrocracking. When the production well's temperatures are at the higher operating temperature (i.e., near 900° F.=upper dashed line), evaporation will be creating vapors of $C_{10}$, $C_{11}$, $C_{12}$, and $C_{13}$ in the latter part of the flow path into the producing wells. In the non-vaporized liquid fractions, significant hydrocracking will occur along the flow path in the porous heating element 20 away from the high temperature injection wells 12.

The series of FIGS. 5A-5E represent some typical examples which can be modified by the unit operator to alternative pressure and temperature values to achieve specific objectives. The producing wells' pressures and temperatures can be changed to achieve the unit operator's specific objectives. Natural well-bore production methods can be used or special, artificial lift technologies can be used as the unit operator can elect. The produced liquids can be in the form of mist, droplets, or slugs with the large volume of vapors (i.e., gases) providing the production lift mechanism in the producing well bores. At the surface, the produced liquids can be simply separated from the gases (vapors) at the well head. Alternatively, some of the vapors can be condensed at the well head to provide an additional liquid fraction.

The resulting liquids and vapors can then be pipelined to a tank farm for liquids and to a centralized gas processing plant for further separation of desired production components. Additional fractionation and product segregation can be done at a centralized, product-preparation plant or refinery. This two-phase flow through porous media creates long residence time, high temperature, intensive hydrocracking of the long chain hydrocarbon molecules, while providing rapid flow, short residence time, for the short chain hydrocarbon molecules in a vapor phase. Consequently, the retorted products produced up the well bore should have very little hydrocarbon components larger than $C_{14}$.

Roughly estimated, the diesel fuel component ($C_{10}$ to $C_{14}$) can be about 20%, the gasoline component ($C_6$ to $C_{10}$) can be about 20%, the condensate component of saturated hydrocarbons ($C_3$ to $C_6$) can be about 15%, the high value, petrochemical feedstock, of unsaturated hydrocarbons ($C_2$ to $C_6$) can be about 15%, and the non-condensable gases ($H_2$, $CH_4$, $C_2H_6$) can be about 30%. However, selective catalysts can be used to optimize the more desired components of this product mixture. Solid granular catalysts can be used as a frac proppant or can be mixed with proppant sand in the hydraulic-fracturing process. When such catalysts are spent and needing to be rejuvenated, a short burst of high-temperature (i.e., possible 1,500° F. to 1,800° F.), superheated steam can be injected through the hydraulic-fracture proppant containing the granular catalysts.

The multiplicity of catalysts, the catalyst-cracking process, and the resulting products have been further described in our Utility Patent Application, titled "Integrated In-Situ Retorting And Refining Of Oil Shale," by Gilman A. Hill and Joseph A. Affholter, as filed in the U.S. Patent Office on Jun. 19, 2006, and given the Ser. No. 11/455,438, now U.S. Pat. No. 7,980,312.

Air Compression for Downhole Generation of a 4 Billion Btu's/d TECF

In the subject oil shale production system 10, the TECF 14 carrying 4 billion Btu's/d (or a substantial fraction thereof), at 1,150° F.±10% temperature and a pressure of about 0.9 psi/ft of depth, must be generated near the bottom of each injection well 12 and then injected into the oil-shale a natural highly-permeable zone 16 or an extensive, propped-frac, highly-permeable hydraulic fracture zone 18. A multitude of alternative systems can be used to accomplish this task in an economic and environmentally acceptable manner, especially during a national energy crisis. Some of these alternative technologies will evolve, with research and development improvements, to be more favorable than others, resulting in changing technologies over time.

The first proposed production system 10 for producing 4 billion Btu's of thermal energy in a TECF is to compress air (i.e., @ 20% $O_2$) or an oxygen enriched air (@ 40% $O_2$) to about 0.9 psi/ft of depth of injection and flow this compressed normal or $O_2$-enriched air down a well bore and through a down hole combustion chamber where fuel is burned while injecting water to control the exhaust temperatures at about 1,150° F.±10%. Many different combinations of air compressors and down hole combustion technology exists in the art. In principle, all available field air-compression and down hole combustion tools can be applied. In such areas of technology, ongoing optimization is expected.

Although many compressor technologies are applicable to the present invention, the best available system appears to be a 350 psi (+30%) twin-screw, rotary air compressor, modified to provide continuous water injection to generate steam for cooling, with a surplus of water left in a liquid state. This type of twin-screw, rotary air compressor is discussed and claimed in U.S. patent application Ser. No. 11/899,905 filed in the Patent Office on Sep. 8, 2007, now U.S. Pat. No. 7,993,110.

Figure 6A:
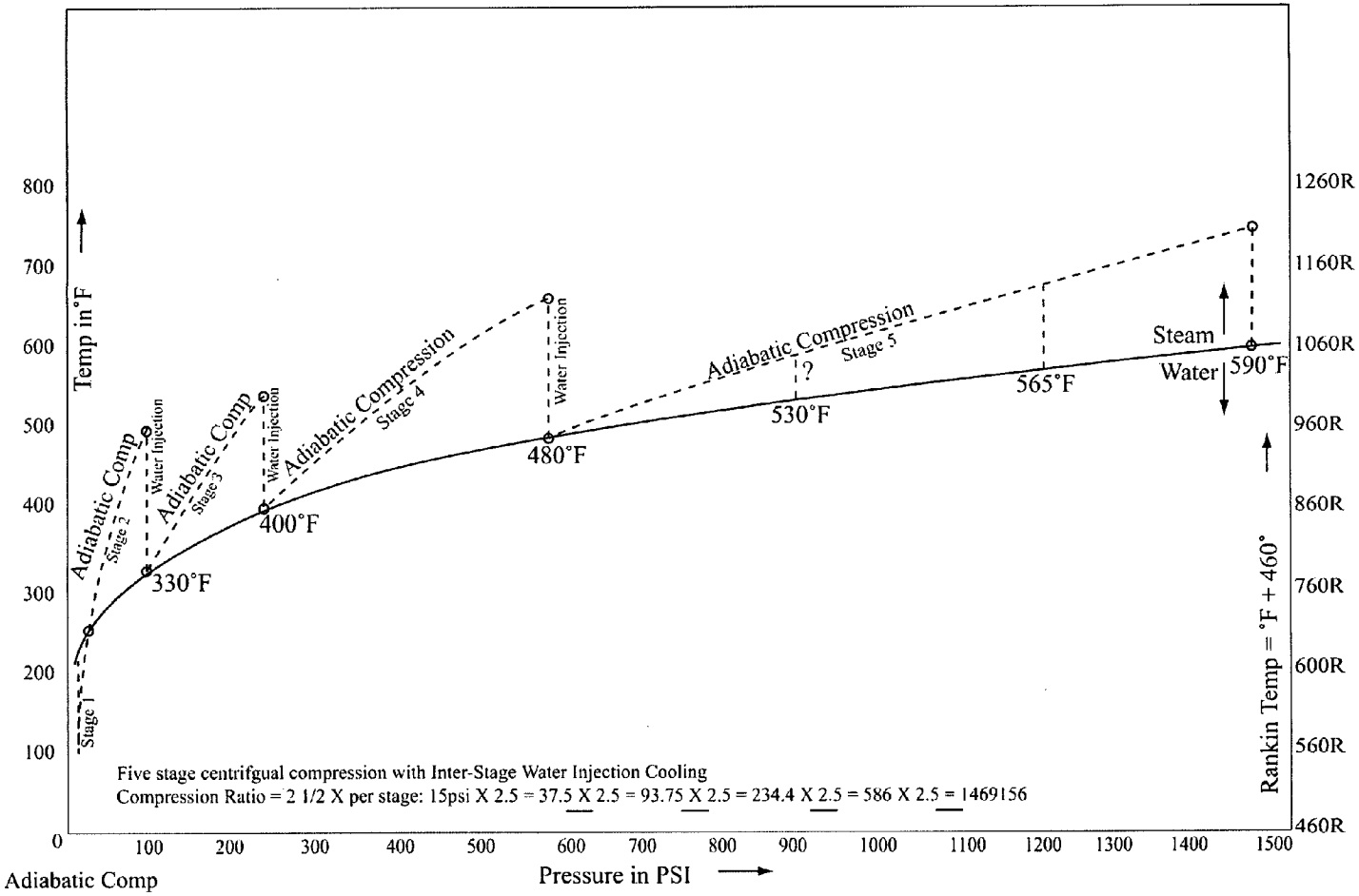
FIGS. 6A and 6B are graphs of pressure and temperature using a five stage compressor with an inter-stage, water-injecting cooling.
Figure 6B:
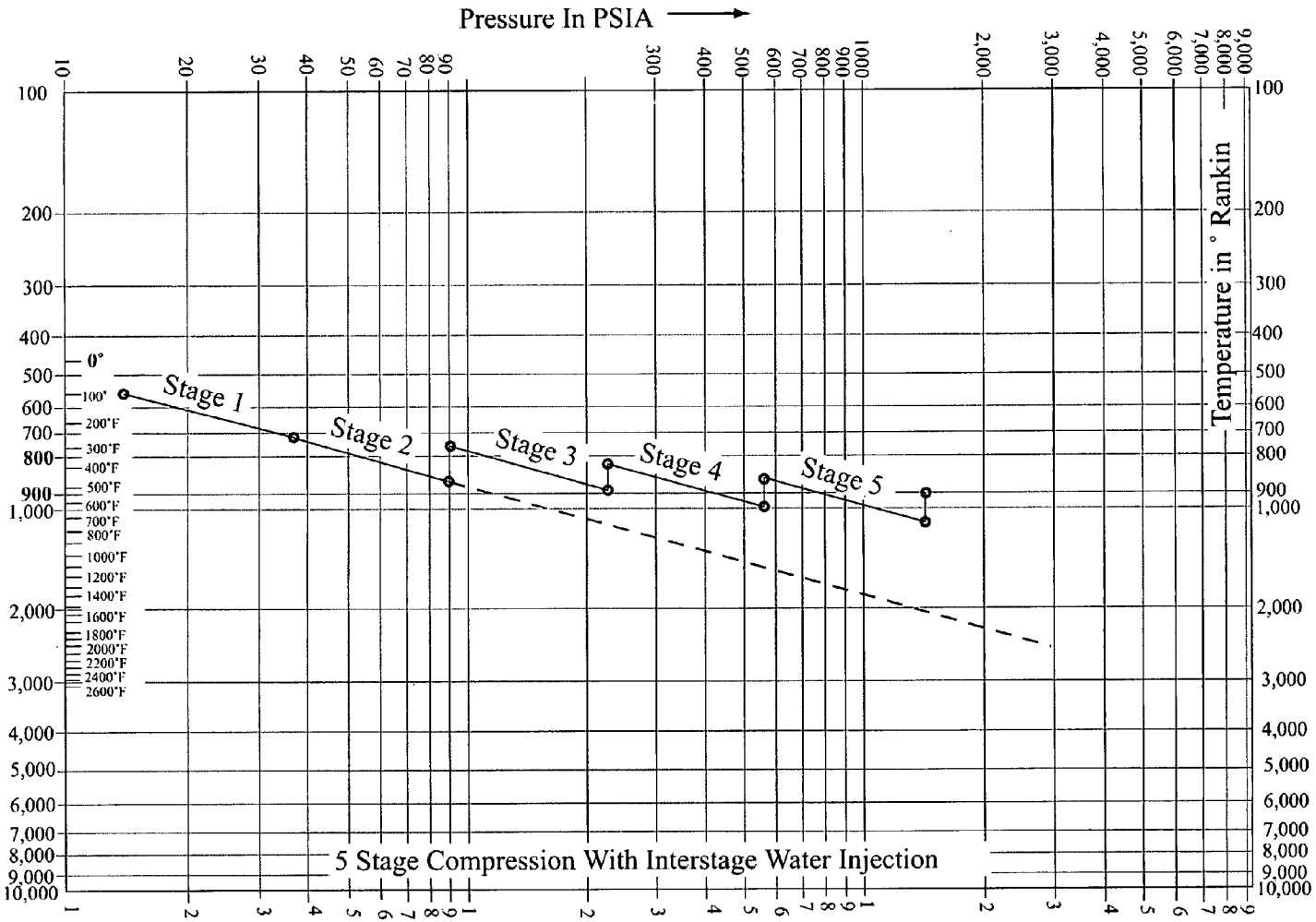

FIG. 6A illustrates a pressure/temperature relationships of a five-stage, centrifugal compressor having an adiabatic-compression pressure ratio of 2.5 times per stage with inter-stage, water-injection evaporation cooling. In each stage, the adiabatic compression creates a high temperature and the interstage, water-injection evaporation will lower the temperature down to the phase-change temperature at that pressure, as shown in this drawing. The injected water becomes steam, which is commingled with the compressed air. The resulting, combined, compressed air and steam must be compressed in the next compression stage and then subsequently cooled by the evaporation of additional injected water in the next inter-stage cooler. FIG. 6B shows the same data of a 5-stage compressor with inter-stage cooling presented on a log/log plot of pressure vs. temperature.

Figure 7A:
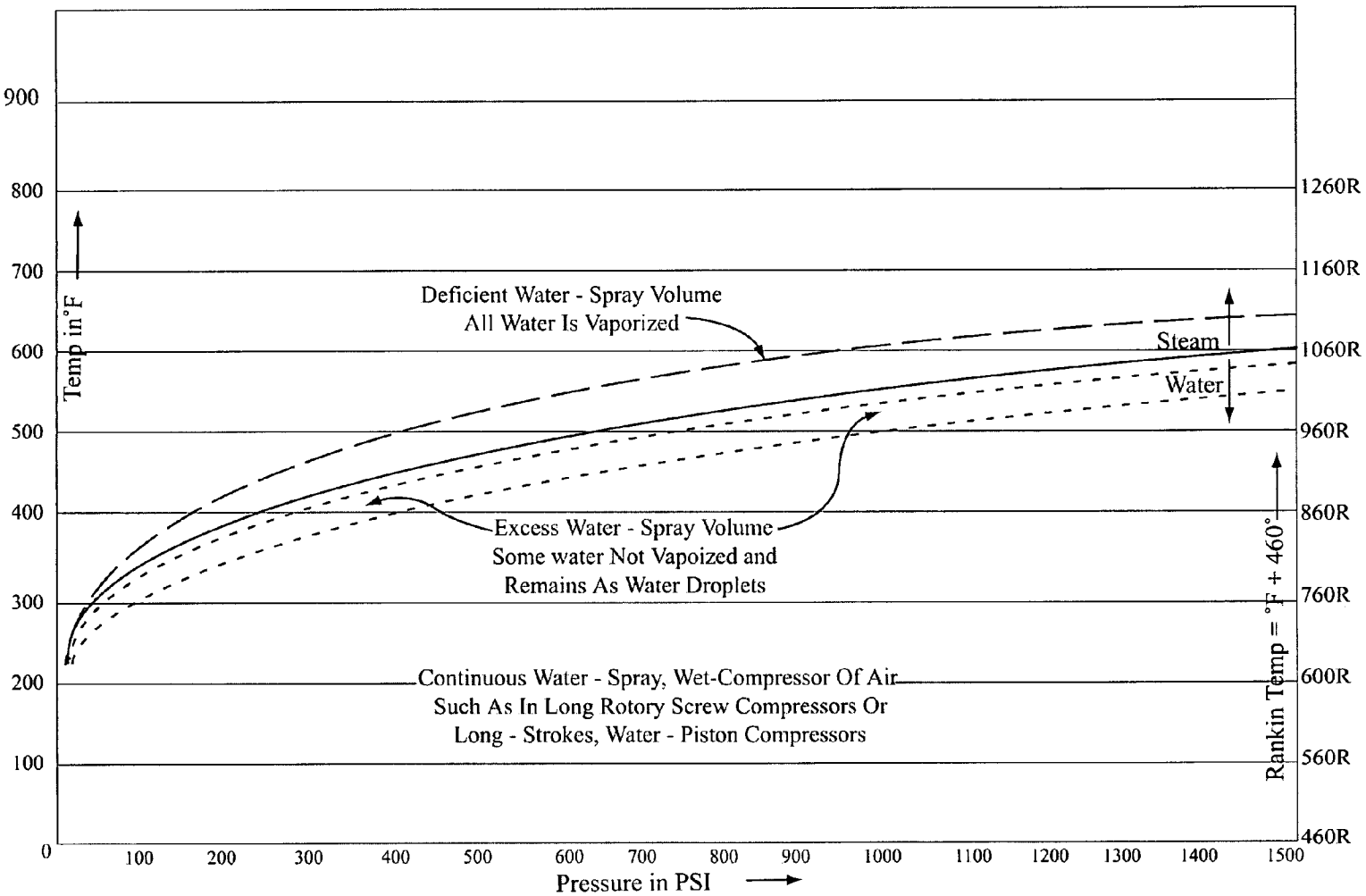
FIGS. 7A and 7B are graphs of pressure and temperature using the five stage compressor with continuous water spray cooling throughout each compression stage.
Figure 7B:
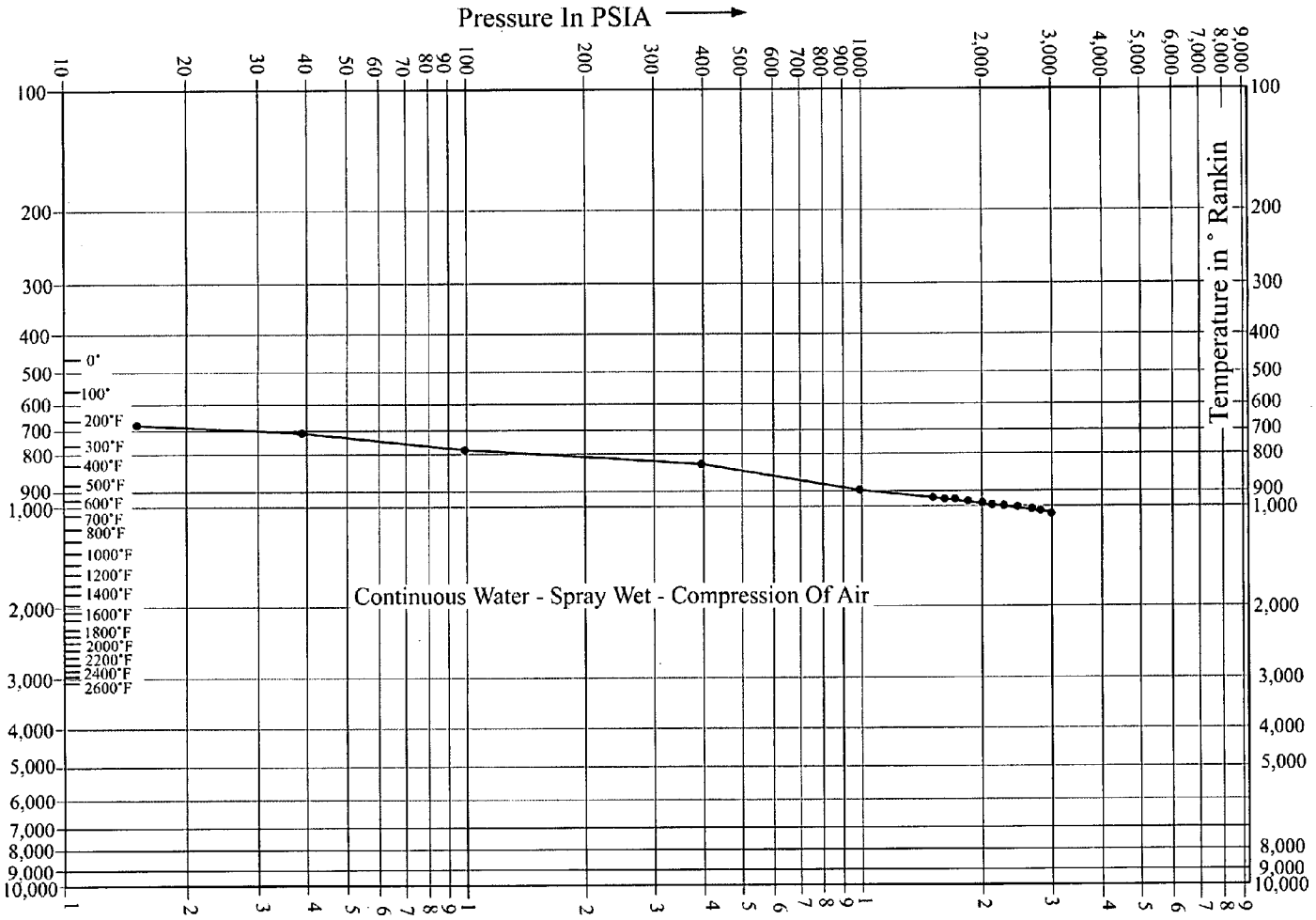

FIG. 7A illustrates a compressor system wherein a water spray for evaporative cooling is continuous throughout each compression stage and is not confined to just an inter-stage cooling system. The solid middle line represents the curve wherein the injected water volume exactly equals the evaporation volume so that no unevaporated water drops remain and no additional water could be evaporated. The lower dotted line represents the condition where excess water is injected and liquid water, as unevaporated droplets or bulk liquid water, is present. The upper dashed line of FIG. 7A represents conditions where insufficient water is injected, resulting in no unevaporated water droplets or bulk water existing in the compressor. FIG. 7B shows the solid-line data of FIG. 7A replotted on a log/log plot.

Figure 8:
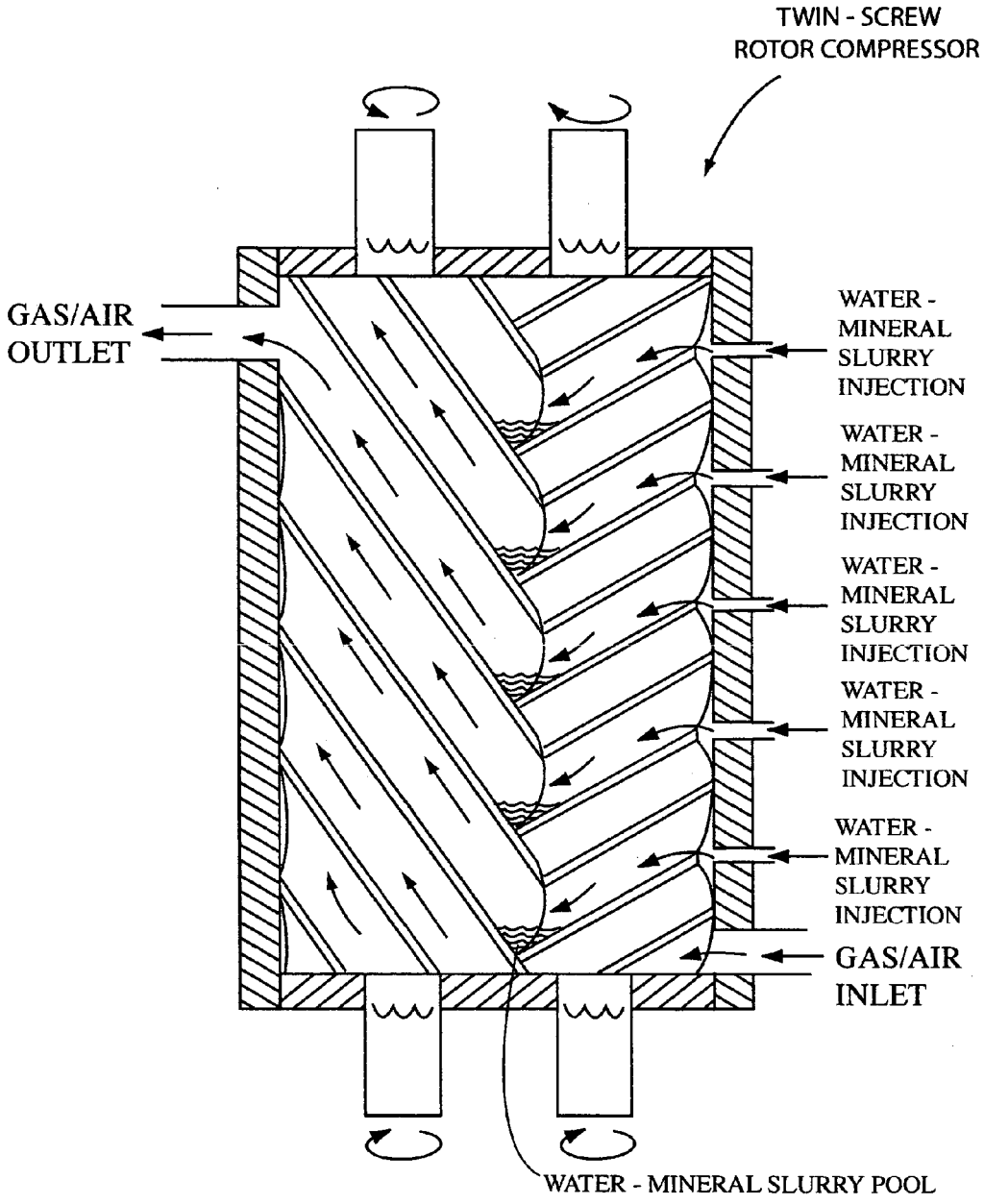
FIG. 8 illustrates a twin-screw compressor designed for very high pressure and temperature applications using in injecting the TECF.

In FIG. 8, a twin-screw, rotor compressor is shown which can be designed to provide a very high-pressure-ratio air compressor. The meshing of a male rotor screw into the female rotor screw makes a semi-positive, displacement-like compression. In this compression system, an excessive water spray volume can be used to create a desired volume of liquid water to lubricate and create a partial liquid seal between the male rotor and female rotor. This condition can be illustrated by the lowest dotted line in FIG. 7A or by the area between the two lower dotted lines in FIG. 7A.

To facilitate the lubrication between the male and female rotors and to increase the liquid seal strength at the meshing of these two rotors, non-combustible, temperature-stable minerals, such as bentonite and some other clay minerals, can be mixed with this water to be injected into the twin-screw, rotor compressors, as shown in FIG. 8. Such minerals, dispersed in the injected water, will provide increased liquid viscosity to increase the sealant quality. Also, the low, mineral-platelet shear strength of the bentonite and some other clay minerals will improve the lubrication between the rotors. Adequate excess water must be maintained to achieve the desired, hydrated-mineral concentration, disbursed in water, for both the desired lubrication and liquid sealant qualities. In most applications, the compressed air/steam will have a temperature below 600° F. and usually below 500° F., or possibly below 400° F., as shown in FIG. 7A.

As a preliminary test, the reservoir of oil coolant in an existing oil-spray-cooled, twin-screw, rotor compressor can be drained, and then oil can be replaced with water or a diluted clay-mineral/water slurry. This water or clay-mineral/water slurry must be injected with sufficient volume into the compressor to have an adequate surplus of water in order to maintain pools of water slurry at each intersection of the male and female rotors and also to prevent dehydration of the clay minerals in the slurry. From these preliminary tests, using an existing oil-cooled, twin-screw compressor, operated in a water-injection mode (i.e., without oil), data can be collected to design more properly our desired, continuous, water-injected and evaporation-cooled, twin-screw, rotor compressor.

This twin-screw, rotor compressor, as shown in FIG. 8, can be operated in reverse as a twin-screw, rotor-expander to extract shaft horsepower from the expanding vapors produced from an in-situ, retorting, production well bore and simultaneously collect the fractionated-condensate liquids condensed during the expansion process. In this reverse-cycle expansion process, the water/clay injectors, shown in FIG. 8, can be used as condensate-fractionation taps to drain off the condensate liquid fractions as they are produced during the expansion. In this expansion-cycle application, the condensed hydrocarbon liquids will form liquid pools at the points of meshing the male and female rotors and thereby provide a vapor sealant and lubricant for the rotors.

Figure 9:
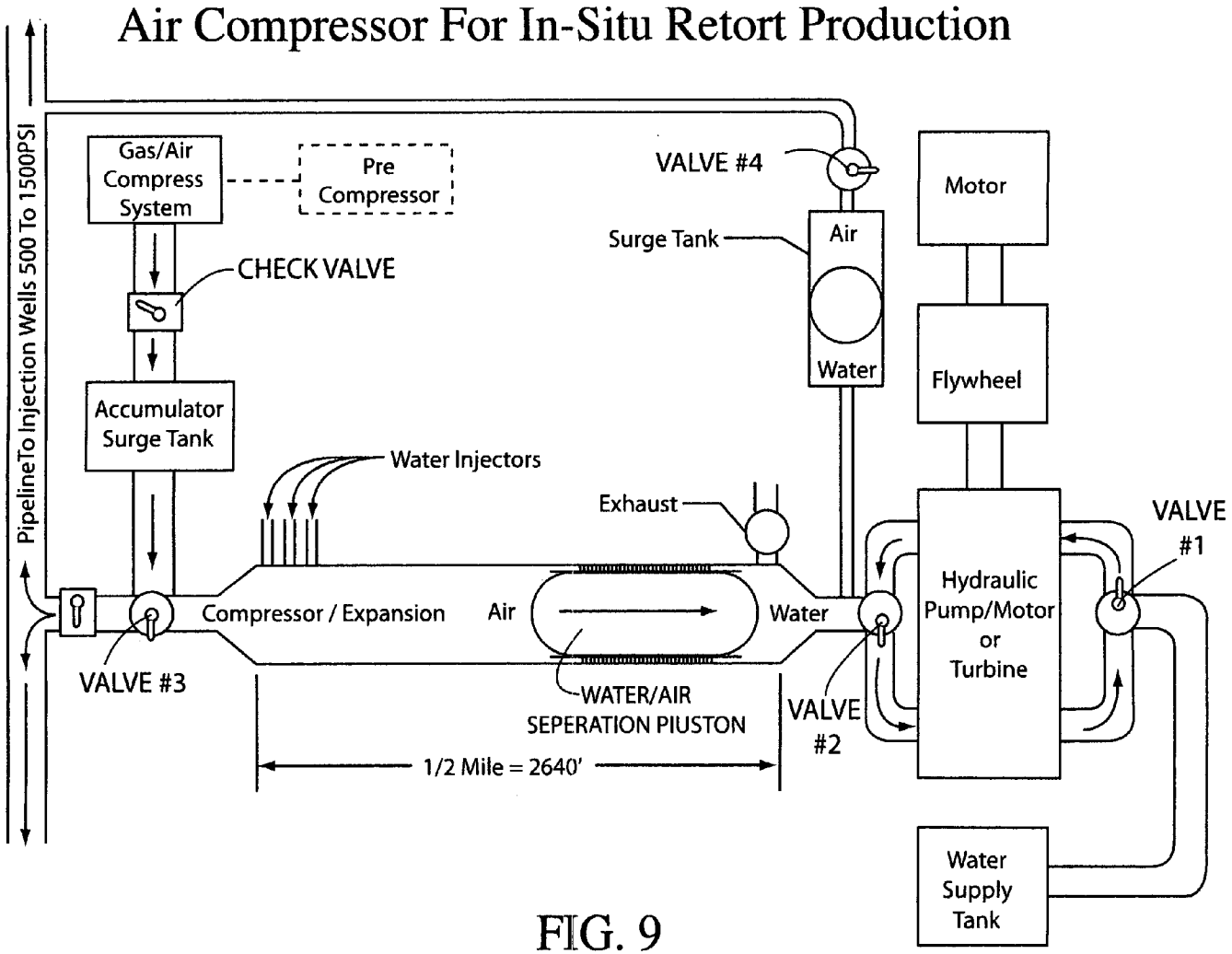
FIG. 9 illustrates a final stage air compressor using a ½ mile long pipeline with a 2 inch I.D.

In FIG. 9, an alternative, final stage of air compression is illustrated using a ½-mile (i.e., 2,640-ft) long pipeline with a 2-ft I.D. to provide about 8,300-$ft^3$ cylinder volume for compression. In FIG. 9, this 8,300-$ft^3$ cylinder volume is precharged with 350 psi compressed air from a 24-atm compressor system, thereby pushing a water/air separator piston to the far end of the ½-mile-long compression cylinder. Then water is pumped through Valves #1 and #2 by the hydraulic pump or turbine and thereby displaces the water/air separator piston (i.e., a modified pipeline pig) along the cylinder compressing the air to the injection well-bore pressure. Then, the compressed air flows through Valve #3 and through the check-valve and into the pipeline to the injection wells. When the water/air piston (i.e., pipeline pig) reaches the far end of this ½-mile-long compression cylinder, Valves #1 and #2 are switched to flow water at 350 psi from the compression cylinder through a hydraulic motor or turbine to generate shaft horsepower and then flow into the water-supply tank. In this operation, Valve #3 connects the 24-atm compressor to the compression cylinder to recharge this cylinder with compressed air at 350 psi in preparation for the next compression stroke.

The 350 psi (±30%) discharge pressure of the twin-screw rotor compressor, as described and shown in FIGS. 7A, 7B, and 8, can be boosted to the desired well-bore injection pressure of 0.9 psi/ft of depth in the well-bore by either (1) an additional stage of the twin-screw rotor compressor (i.e., FIG. 8) designed for this higher pressure, or (2) by the water-piston-driven displacement ball (or pipeline pig) in a long pipe (cylinder) laid on (or under) sloping ground, as shown in FIG. 9 and further described in the prior referenced, provisional patent application.

Each of these, near parallel, ½-mile-to-¾-mile-spaced, road/pipeline-access rights-of-way is about 10 miles long with about 160 primary well sites spaced about $1/16^{th}$ mile apart, along each such right-of-way (i.e., 16 well sites per mile for 10 miles). With the injection of about 4 billion Btu's/d of TECF for each of 160 well sites, the injected TECF would be about 640 billion Btu's/d on each such pipeline right-of-way. If 40% $O_2$-enriched compressed air is used for the down hole combustion to produce 640 billion Btu's/d of TECF, enriched-air compression volume would be:

(A) 14,000 scfm/well site (20 mmscf/d/well site=403 mcf/d/well site @ 50 atm=750 psi)

(B) 224,000 scf/mile (322 mmscf/d/mile=6,451 mcf/d/mile @ 50 atm=750 psi)

(C) 2,240,000 scfm/10 miles pipeline (3,225 mmscf/d/10 mi=64.5 mmcf/d/10 mi @ 50 atm)

When it is determined that sufficient economies of scale for centralized production and distribution of a compressed air resource, this will likely become a preferred source. In this scenario, one or more large-diameter, compressed-air pipelines can be used to connect all of the primary drill sites along a pipeline right-of-way to a small number of compressor stations. In one embodiment, compressor substations can be placed in fixed intervals along a 10-mile-long pipeline. For example, a single compressor station producing 2,240,000 scfm (i.e., 3,225 mmscf/d) would provide sufficient compressed air for 160 well sites. In contrast, 10 compressor stations at 1-mile spacing, each producing 224,000 scfm (i.e., 320 mmscf/d) for 16 well sites or any other combination of compressor station, volume, and spacing. In this pipeline, the wet-compressed-air or $O_2$-enriched-air pressure would be about 0.9 psi/ft of well depth, and the temperature would be about 500° F. to 600° F., as illustrated in FIG. 6A.

This compressed air, or $O_2$-enriched air, from the drill site's connecting pipelines will be injected down each injection well 12 to support the burning of fuel in a downhole combustion chamber, with water injection to control the combustion exhaust temperature at about 1,150° F.±10%. The injected-TECF's combustion exhaust has substantial amounts of $H_2O$, $CO_2$, CO, and unburned $CH_4$ fuel, which are all useful components in the hot TECF for (1) the retorting of kerogen from the oil-shale rock and (2) the cracking/refining of the shale oil to produce more valuable hydrocarbon products. Nitrogen gas ($N_2$) is a non-useful dilatant, which should be minimized in the production of this TECF, resulting in the saving of compression costs and in increasing the TECF-Btu injection capacity of each well-bore.

The above mentioned twin-screw, air compressor, shown in FIG. 8, and the large volume, air compressor system, shown in FIG. 9, are described in detail and claimed in U.S. patent application Ser. No. 11/899,905 filed on Sep. 8, 2007, now U.S. Pat. No. 7,993,110, and having a title of "Steam-Generator and Gas-Compressor Systems using Water-Based Evaporative Coolants, Sealants, and Lubricants, by Gilman A. Hill.

Production-Well Operations and Equipment for Product Recovery:

Each 4 billion Btu/d of TECF injected into one or more injection well bores will produce about 2,700 boe/d gross production through one or more production well bores, of which about 700 boe/d will be consumed in the 4 billion Btu/d of TECF injection, leaving about 2,000 boe/d of net marketable production. In the in-situ-retorting operation, it can include 16 injection wells per mile along one road/pipeline right-of-way and 16 production wells per mile along a near parallel road pipeline right-of-way, spaced about ½ to ¾-mile from the right-of-way for injection wells.

In the context of an urgent, energy-crisis development schedule, the first, well-site-product-fractionation-equipment development stage can consist simply of a condenser to separate the $C_6$-and-higher-weight, condensable-liquid hydrocarbons from $C_1$ to $C_5$ vapors. The $C_6$-and-higher condensed liquids can then be shipped by pipeline to a refinery for further fractionation, and the $C_5$ and lighter hydrocarbon can be shipped by pipeline to a large natural gas processing plant located within the unit area. If the TECF exhaust product contains too much nitrogen ($N_2$) gas so that this existing, natural-gas processing plant cannot handle our $C_1$ to $C_5$ gas, diluted by $N_2$, $CO_2$, and $H_2O$, then we can need an on-site separator for the $C_3$, $C_4$, and $C_5$ fractions for pipeline marketing, followed by expansion condensation of $H_2O$ and $CO_2$, and then an on-site combustion heater using $C_1$, $C_2$, and $H_2$ gases, diluted by $N_2$. Some of this $N_2$ can be removed by an $N_2$ molecular sieve to provide better combustion gas.

At a subsequent time, more elaborate, product-processing equipment will be developed and installed to provide higher efficiencies and improved product quality to achieve better environmental conditions and higher profits. Such improved gas-expansion/condensation, product-fractionation equipment can be designed, manufactured, and installed after production development and operation are well progressed in meeting our urgent, energy-crisis needs.

Additional Embodiments

The methods of this invention provide for circulation of certain thermal energy carrier fluids between injection openings and production wells using one or more highly-permeable zones that enable fluid communication between injection and production wells and reversal of this function between the wells. In the context of this invention the term circulation refers generally to any operator-controlled, directional flow of formation (including fluids that are injected in the wells) fluids within one or more the highly-permeable zones. Circulating the injected fluids from the injection well through the high-permeable zone and toward production well previously play an important operational role in the present invention.

In an alternative embodiment, the concentration of at least one solute or contaminant in water is reduced by a method comprising the step of injecting the solute or contaminant-containing water into the formation through one or more injection wells, circulating the injected water through the highly-permeable zone, creating one or more porous heating elements within the formation, providing for transfer of formation heat to water in the porous heating element so as to result in substantial vaporization of the water, producing the vapor through one or more production wells, and condensing water having reduced levels of one or more solutes. The water having reduced levels of at least one organic or mineral solute is considered hereby to be substantially purified water.

The substantially purified water is preferably condensed, collected and stored in one or more surface vessels or reservoirs. Also, the water can be optionally distributed through surface operations to natural or artificial aquifers, surface ponds, lake, streams or surface reservoirs. In one embodiment, mineral solutes (e.g. sodium, potassium metals and other mineral salts), that are present in formation waters at levels incompatible with fresh water ecosystems, are precipitated (re-mineralized) within the formation upon vaporization, resulting in steam with reduced solute mineral levels. The reduced-solute steam is produced at the surface, condensed and either collected in one or more collection vessels or reservoirs or released to support natural or enhanced ecosystems.

In an alternative embodiment, water containing one or more organic solutes is substantially purified using the instant invention. Preferably, the organic solutes are environmentally undesirable and/or present at biologically relevant levels. Preferably, at least one organic solute is present at a level of >1 part-per-billion; more preferably, at a level of >1 part-per-million; and most preferably, at a level of >0.1% (1 part-per-thousand). The organic solute-containing water can be derived from a geological formation or from any other natural or man-made source, such as industrial, municipal or geological sources. Water containing one or more organic solutes is purified by a method comprising the step of injecting the solute-containing water into a formation through one or more injection well(s), circulating the injected water in the formation using the highly-permeable zone, contacting one or more carbon-rich adsorption surfaces, such as those created by in situ retorting and refining using the methods of the instant invention, or one or more porous heated zones within the formation, typically, the heated zone will comprise sufficient heat to cause vaporization of a substantial portion of the water, or using both types of zones within the formation, producing the water or water vapor through one or more production wells, and collecting substantially purified water, i.e. having reduced levels of at least one organic solute. Preferably, the water circulated through the permeable zones undergoes vaporization, and the vapor is conducted to the surface through one or production openings. Preferably, the collection of reduced-solute water involves condensation of vapor produced from the formation. Optionally, the method and system further comprises passing produced vapor through one or more surface condensing zones or adsorption matrices to further reduce organic solutes.

For producing substantially purified water, the method of this invention also, optionally comprises selectively condensing produced water vapor along an operator-controlled surface that maintains a temperature of 50-210 degrees F. Preferably, optional condensing surface would have an average temperature of 60-200 degrees F. or, more preferably, 75-185 degrees F. In certain applications, optional water condensing surfaces can be adjusted to a temperature in excess of 90 degrees F. Optional water condensing zones can be followed by further condensing zones that capture low-boiling organic solutes and hydrocarbons.

In another embodiment, steam produced from the formation is used both to generate electrical power and to produce purified water according to the methods described herein. In this embodiment, at least a portion of the produced water is collected and stored or distributed in at least one surface reservoir or vessel, and not recycled into the formation as part of the steam-based electrical power generation cycle.

While the invention has been particularly shown, described and illustrated in detail with reference to the preferred embodiments and modifications thereof, it should be understood by those skilled in the art that equivalent changes in form and detail can be made therein without departing from the true spirit and scope of the invention as claimed except as precluded by the prior art.

The embodiments of the invention for which as exclusive privilege and property right are claimed are defined as follows:

1. A method of producing hydrocarbons in situ from an oil shale fixed-bed hydrocarbon formation disposed below a ground surface and having a naturally occurring, highly-permeable zone next to an upper less-permeable zone and a lower less-permeable zone, the highly-permeable zone having a permeability in a range of 0.10 to 10 darcy, the upper and lower less-permeable zones having a permeability in a range of 0.00010 to 0.010 darcy, the steps comprising:

providing at least one injection well in the naturally occurring, highly-permeable zone of the formation;

providing at least one production well in the naturally occurring, highly-permeable zone of the formation;

injecting a heated thermal-energy carrier fluid into the injection well;

circulating the carrier fluid through the naturally occurring, highly-permeable zone of the formation and creating a porous heating element therein, the porous heating element providing an underground surface area for heating the highly-permeable zone, the porous heating element disposed between the upper and lower less-permeable zones;

using the porous heating element for heating the upper less-permeable zone above the highly-permeable zone and using the porous heating element for heating the lower less-permeable zone and producing mobilized hydrocarbons therefrom;

producing at least a portion of mobilized hydrocarbons from the porous heating element and flowing the hydrocarbons with carrier fluid through the production well to the ground surface; and removing at least one selected hydrocarbon held in the carrier fluid.

2. The method of claim 1 wherein the steps of providing at least one injection well and at least one production well includes providing a plurality of parallel equally spaced apart injection wells and a plurality of parallel equally spaced apart production wells.

3. The method of claim 1 wherein the injection wells are spaced apart from each other in a range of 200 to 500 feet and the production wells are spaced apart from each other in a range of 200 to 500 feet.

4. The method of claim 1 wherein the injection wells are spaced apart form the production wells in a range of ½ to 1 mile.

5. The method of claim 4 wherein the porous heating element in the highly-permeable zone has a length between an injection well and a production well in a range of ½ to 1 mile and a porous heating element having a width in a range of 200 to 500 feet.

6. The method of claim 1 wherein the temperature of the carrier fluid circulated through the highly-permeable zone is in a range of 900 to 1300 degrees F.

7. A method of producing hydrocarbons in situ from an oil shale fixed-bed hydrocarbon formation disposed below a ground surface and having a first and second naturally occurring, highly-permeable zones next to an upper less-permeable zone and a lower less-permeable zone, the lower less-permeable zone disposed between the highly-permeable zones, the highly-permeable zones having a permeability in a range of 0.10 to 10 darcy, the upper and lower less-permeable zones having a permeability in a range of 0.00010 to 0.010 darcy, the steps comprising:

providing at least one injection well in the first and second naturally occurring, highly-permeable zones of the formation;

providing at least one production well in the first and second naturally occurring, highly-permeable zones of the formation;

injecting a heated thermal-energy carrier fluid into the injection well;

circulating the carrier fluid through the naturally occurring first and second highly-permeable zones of the formation and creating a thermal porous heating element therein, the porous heating element providing an underground surface area for heating the first and second highly-permeable zones;

using the porous heating element for heating the lower less-permeable zone between the first and second highly-permeable zones and producing hydrocarbons therefrom;

producing at least a portion of mobilized hydrocarbons from the porous heating element in the first and second highly-permeable zones and flowing the hydrocarbons with carrier fluid through the production well to the ground surface; and removing at least one selected hydrocarbon held in the carrier fluid.

8. The method of claim 7 wherein the steps of providing at least one injection well and at least one production well includes providing a plurality of parallel equally spaced apart injection wells and a plurality of parallel equally spaced apart production wells in the first and second highly-permeable zones.

9. The method of claim 7 further including a step of creating a first highly-permeable, hydraulic fracture zone in the lower less-permeable zone and circulating the carrier fluid therethrough, creating a porous heating element therein, and producing hydrocarbons therefrom.

10. The method of claim 9 further including a step of creating a second highly-permeable, hydraulic fracture zone in the lower less-permeable zone and parallel to the first highly-permeable, hydraulic fracture zone, circulating the carrier fluid therethrough, creating a porous heating element therein, and producing hydrocarbons therefrom.

11. The method of claim 7 wherein the temperature of the carrier fluid circulated through the highly-permeable zones is in a range of 900 to 1300 degrees F.

12. A system of producing hydrocarbons in situ from an oil shale fixed-bed hydrocarbon formation disposed below a ground surface and having a naturally occurring, highly-permeable zone next to an upper less-permeable zone and a lower less-permeable zone, the highly-permeable zone having a permeability in a range of 0.10 to 10 darcy, the upper and lower less-permeable zones having a permeability in a range of 0.00010 to 0.010 darcy, the system comprising:

at least one injection well in the naturally occurring, highly-permeable zone of the formation;

at least one production well in the naturally occurring, highly-permeable zone of the formation;

a heated thermal-energy carrier fluid received through the injection well and circulated through the highly-permeable zone of the formation; and a thermal porous heating element formed by the carrier fluid in the highly-permeable zone, the porous heating element providing an underground surface area for heating the highly-permeable zone, the porous heating element also heating the upper less-permeable zone above the highly-permeable zone, the porous heating element also heating the lower less-permeable zone below the highly-permeable zone, the porous heating element mobilizing the hydrocarbons in the highly-permeable zone and the upper and lower less-permeable zones, the hydrocarbons with carrier fluid flowing upwardly through the production well to the ground surface.

13. The system as described in claim 12 further including a plurality of parallel equally spaced apart injection wells and a plurality of parallel equally space apart production wells.

14. The system as described in claim 13 wherein the injection wells are spaced apart from each other in a range of 200 to 500 feet and the production wells are spaced apart from each other in a range of 200 to 500 feet.

15. The system as described in claim 13 wherein the injection wells are spaced apart from the production wells in a range of ½ to 1 mile.

16. The system as described in claim 12 wherein the porous heating element in the highly-permeable zone has a length between an injection well and a production well in a range of ½ to 1 mile, the porous heating element having a width in a range of 200 to 500 feet.

17. The system as described in claim 12 wherein the temperature of the carrier fluid circulated through the highly-permeable zone is in a range of 900 to 1300 degrees F.

18. A system of producing hydrocarbons in situ from an oil shale fixed-bed hydrocarbon formation disposed below a ground surface and having a first naturally occurring, highly-permeable zone, a second naturally occurring, highly-permeable zone and a less-permeable zone disposed between the first and second highly-permeable zones, the first and second highly-permeable zone having a permeability in a range of 0.10 to 10 darcy, the less-permeable zone having a permeability in a range of 0.00010 to 0.010 darcy, the system comprising:

at least one injection well in the first and second naturally occurring, highly-permeable zone of the formation;

at least one production well in the first and second naturally occurring, highly-permeable zone of the formation;

a heated thermal-energy carrier fluid received through the injection well and circulated through the first and second highly-permeable zones of the formation; and a thermal porous heating element created in the first and second highly-permeable zones by the carrier fluid, the porous heating element providing an underground surface area for heating the first and second highly-permeable zone, the porous heating element in the first and second highly-permeable zones also providing a heat source for heating the less-permeable zone therebetween, the porous heating element mobilizing the hydrocarbons in the first and second highly-permeable zone and the less-permeable zone, the hydrocarbons with carrier fluid flowing upwardly through the production well to the ground surface.

19. The system as described in claim 18 further including a plurality of parallel equally spaced apart injection wells and a plurality of parallel equally spaced apart production wells in the first and second highly-permeable zones.

20. The system as described in claim 18 further including a first highly-permeable, hydraulic fracture zone in the less-permeable zone for circulating the carrier fluid therethrough, creating a porous heating element therein, and producing hydrocarbons therefrom.

21. The system as described in claim 20 further including a second highly-permeable, hydraulic fracture zone in the less-permeable zone and parallel to the first highly-permeable, hydraulic fracture zone for circulating the carrier fluid therethrough, creating a porous heating element therein, and producing hydrocarbons therefrom.

22. The system as described in claim 18 wherein the temperature of the carrier fluid circulated through the first and second highly-permeable zones is in a range of 900 to 1300 degrees F.

* * * * *